US007132019B2

(12) United States Patent
Koshiba et al.

(10) Patent No.: US 7,132,019 B2
(45) Date of Patent: Nov. 7, 2006

(54) AMORPHOUS SOFT MAGNETIC ALLOY POWDER, AND DUST CORE AND WAVE ABSORBER USING THE SAME

(75) Inventors: Hisato Koshiba, Tokyo (JP); Hidetaka Kenmotsu, Tokyo (JP); Yutaka Naito, Tokyo (JP); Takao Mizushima, Tokyo (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/111,336

(22) Filed: Apr. 21, 2005

(65) Prior Publication Data

US 2005/0236071 A1 Oct. 27, 2005

(30) Foreign Application Priority Data

Apr. 22, 2004 (JP) ..... 2004-126784

(51) Int. Cl.
*H01F 1/147* (2006.01)
*H01F 1/153* (2006.01)

(52) U.S. Cl. ..... 148/304; 148/403

(58) Field of Classification Search ..... None
See application file for complete search history.

(56) References Cited

U.S. PATENT DOCUMENTS 5,522,948 A * 6/1996 Sawa et al. ..... 148/308
5,651,841 A 7/1997 Moro et al.
5,738,733 A 4/1998 Inoue
5,876,519 A 3/1999 Inoue et al.

FOREIGN PATENT DOCUMENTS

| | | |
|---|---|---|
| JP | 8-37107 | 2/1996 |
| JP | 8-333660 | 12/1996 |
| JP | 9-256122 | 9/1997 |
| JP | 2002-226956 | 8/2002 |
| JP | 2004-156134 | 6/2004 |

* cited by examiner

*Primary Examiner*—John P. Sheehan
(74) *Attorney, Agent, or Firm*—Brinks Hofer Gilson & Lione

(57) ABSTRACT

An amorphous soft magnetic alloy powder which is produced by a water atomization method is provided. The powder contains an amorphous phase having a temperature interval ΔTx of a supercooled liquid of 20K or more; having a hardness Hv of 1000 or less; is provided with a layer with a high concentration of Si at a surface portion thereof; and being represented by the following composition formula:

$$Fe_{100-a-b-x-y-z-w-t}CO_aNi_bM_xP_yC_zB_wSi_t$$

And M is one or two or more elements selected from Cr, Mo, W, V, Nb, Ta, Ti, Zr, Hf, Pt, Pd, and Au.

8 Claims, 9 Drawing Sheets

SAMPLE 9 $Fe_{77.4}P_{7.3}C_{2.2}B_{7.7}Si_{5.4}$

AMORPHOUS SOFT MAGNETIC ALLOY POWDER, AND DUST CORE AND WAVE ABSORBER USING THE SAME

This application claims the benefit of priority to Japanese Patent Application No. 2004-1 26784, filed on Apr. 22, 2004, herein incorporated by reference.

BACKGROUND OF THE INVENTION

1. Field of the Invention

The present invention relates to an amorphous soft magnetic alloy powder which can be produced by using a water atomization method, and a dust core and a wave absorber using the same.

2. Description of the Related Art

Conventionally, a Fe—Al—Ga—P—C—B—Si-based alloy is known as an amorphous soft magnetic alloy in which an amorphous phase can be formed by quenching a molten alloy (for example, refer to U.S. Pat. No. 5,738,733 or U.S. Pat. No. 5,876,519). Of the conventional amorphous soft magnetic alloys, some amorphous soft magnetic alloys having a specific composition are known as metal glassy alloys which have a wide temperature region in which they are in a state of a supercooled liquid before crystallization. It should be noticed that these metal glassy alloys have excellent soft magnetic characteristics and form easily bulky alloys having a thickness larger than the conventionally known amorphous alloy ribbon having a different composition, which is prepared by a liquid quenching method.

However, because these metal glassy alloys are produced by a liquid quenching method such as a single roll, it is required to improve their own amorphous phase-forming abilities to some extent. Therefore, the main object in the development of such a metal glassy alloy was to improve its amorphous phase-forming ability, and the development has progressed from investigations of an alloy composition capable of achieving this object. However, the composition which is capable of increasing the amorphous phase-forming ability of the alloy does not always coincide with the composition which is capable of increasing soft magnetic characteristics, and thus there is still room for further improvement in a high saturated magnetization and soft magnetic characteristics.

Further, since the metal glassy alloy having the conventional composition contains a high-priced gallium (Ga), it is not appropriate for the mass production. Therefore, the glassy alloy is desired to have a composition capable of decreasing the manufacturing cost.

On the other hand, the glassy alloy manufactured by the single roll method can be obtained as a ribbon having a thickness of about 200 μm. For applying this ribbon to a magnetic core such as a trans and a choke coil, the ribbon is grinded into a powder, the powder is mixed with a binder such as a resin, and the resultant mixture is solidified and molded to produce a dust core.

In order to overcome the above-mentioned problems, a soft magnetic alloy powder such as a Fe—Al—Si-based alloy and a Mo permalloy (for example, refer to U.S. Pat. No. 5,651,841) has been proposed. The method of producing this soft magnetic alloy powder has employed a gas atomization method in which a molten alloy is quenched by spraying an inert gas thereto, or a water atomization method in which a molten alloy is quenched by blowing the molten alloy into water.

When the Fe—Al—Si-based alloy powder is used, a relatively low core loss is obtained, but a saturated magnetization is low and a DC superimposing characteristic is deteriorated. Further, Mo permalloy has a high core loss, and thus there is room for improvement in the practical use thereof. Therefore, in order to solve such problems, there is an attempt for obtaining a dust core having characteristics of a high saturated magnetization and a low core loss by pulverizing a Fe-based amorphous soft alloy, but there are problems in that the optimization of the shape of the powder is not sufficiently made and it is difficult to obtain excellent magnetic characteristics in the dust core of the amorphous alloy powder.

According to a gas atomization method, it is possible to obtain an amorphous soft alloy powder which has a spherical shape and a small amount of impurity (the content of oxygen is small). However, since an expensive inert gas is used in a large quantity to grind and cool down a molten alloy, the manufacturing cost increases. Further, it is difficult to make a manufacturing apparatus large to grind the molten alloy by using an inert-gas jet. Furthermore, since the inert gas is supplied from a gas bomb, the grinding pressure is merely increased to about 20 MPa, and it was difficult to increase a manufacturing efficiency. Therefore, the amorphous soft magnetic alloy powder produced by the gas atomization method has a problem in that the manufacturing cost thereof is high and thus it is not suitable for the mass production thereof.

Therefore, it is studied and investigated to employ a water atomization method which is conducted under an atmosphere of air, instead of the gas atomization method. If the water atomization method is employed, it is possible to make the manufacturing apparatus large and the molten alloy can be jetted at a high pressure, and thus the mass production can be enhanced. Further, since the cooling velocity in the water atomization method is generally high as compared to the case in which the inert gas is used, it is easy to make the molten alloy amorphous. However, when the metal glassy alloy is made by using the water atomization method, there are problems in that liquid droplets of a high temperature molten alloy are quenched while coming into contact with water to easily corrode components of the alloy uselessly, and thus a large oxidized portion results in the obtained powder.

In view of such a background, the inventors of the present invention have developed a glassy alloy of the composition into which an element such as Cr and a noble metal is added for enhancing a corrosion-resistant effect, as a composition in which the corrosion hardly occurs even though the water atomization method is used, have tried to improving the characteristic of the glassy alloy powder, and have made progress the research and development in JP-A No. 2002-226956 or No. 2004-156134.

SUMMARY OF THE INVENTION

The present invention has been made in consideration of the above circumstances, and an advantage of the invention is that it provides an amorphous soft magnetic alloy powder and a flat amorphous soft magnetic alloy powder which can be produced by a water atomization method and which are improved in a magnetic permeability and a DC superimposing characteristic at a state in which a core loss is lowered, and a dust core and a wave absorber, as a result of a research of a composition in which the corrosion hardly occurs even though it is made by using water atomization method with attention being paid to Si.

The present invention has been made in consideration of the above circumstances, and according to an aspect of the invention there is provided an amorphous soft magnetic alloy powder, which is produced by a water atomization method in which liquid droplets of a molten alloy are jetted so as to bring into contact with water and are quenched. The powder comprises Fe as a major component, contains at least P, C, B, and Si, comprises an amorphous phase having a temperature interval ΔTx of a supercooled liquid as represented by ΔTx=Tx−Tg (wherein Tx is a crystallization initiation temperature and Tg is a glass transition temperature, respectively) of 20K or more, has a hardness Hv of 1000 or less, is provided with a layer with a high concentration of Si at a surface portion thereof, and is represented by the following composition formula:

$$Fe_{100-a-b-x-y-z-w-t}Co_aNi_bM_xP_yC_zB_wSi_t$$

wherein M is one or two or more elements selected from Cr, Mo, W, V, Nb, Ta, Ti, Zr, Hf, Pt, Pd, and Au, with a, b, x, y, z, w and t representing composition ratios in a range of $0 \leqq x \leqq 3$, $2 \leqq y \leqq 15$, $0 \leqq z \leqq 8$, $1 \leqq w \leqq 12$, $0.5 \leqq t \leqq 8$, $0 \leqq a \leqq 20$, $0 \leqq b \leqq 5$ and $70 \leqq (100-a-b-x-y-z-w-t) \leqq 80$ in atomic %, respectively.

It is preferable that the amorphous soft magnetic alloy powder of the invention have contents of Si and P satisfying a relation of $0.28<\{Si/(P+Si)\}<0.45$.

It is preferable that the amorphous soft magnetic alloy powder of the invention have the layer with a high concentration of Si formed within a depth of 100 Å from the surface of the powder.

It is preferable that the amorphous soft magnetic alloy powder of the invention comprise an alloy having magnetic characteristics of a saturated magnetization σs of not less than $180\times10^{-6}$ Wbm/kg and a coercive force of not more than 10 A/m.

It is preferable that a flat amorphous soft magnetic alloy powder of the invention be produced by flattening the amorphous soft magnetic alloy powder.

According to another aspect of the invention there is provided a dust core, which is obtained by mixing one or more amorphous soft magnetic alloy powders mentioned above, an insulating material, the insulating material serving as a binder, and a lubricant and granulating the resultant mixture into a granulated powder and solidifying and molding the granulated powder.

According to a further aspect of the invention there is provided a dust core, which is obtained by mixing one or more amorphous soft magnetic alloy powders mentioned above, an insulating material, the insulating material serving as a binder, and a lubricant and granulating the resultant mixture into a granulated powder and solidifying and molding the granulated powder, thereby consolidating the amorphous soft magnetic alloy powder which comprises an alloy having magnetic characteristics of a saturated magnetization σs of not less than 180×10⁻6 Wbm/kg and a coercive force of not more than 10 A/m and has D50 of 5 to 30 μm, a tap density of 3.7 $Mg/m^3$ or more, a specific surface area of 0.35 $m^2/g$ or less, and an oxygen concentration of 3000 ppm or less, the dust core having W of 400 $kW/m^3$ or less at 100 kHz, 0.1 T, and a constant magnetic permeability (μ') of 60 to 100 at 1 MHz or less, and exhibits μ (DC=5500 A/m) of 35 to 40.

According to a still further aspect of the invention there is provided a wave absorber, which is obtained by mixing the amorphous soft magnetic alloy powder or the flat amorphous soft magnetic alloy powder with an insulating material.

DESCRIPTION OF THE PREFERRED EMBODIMENT

Figure 1:
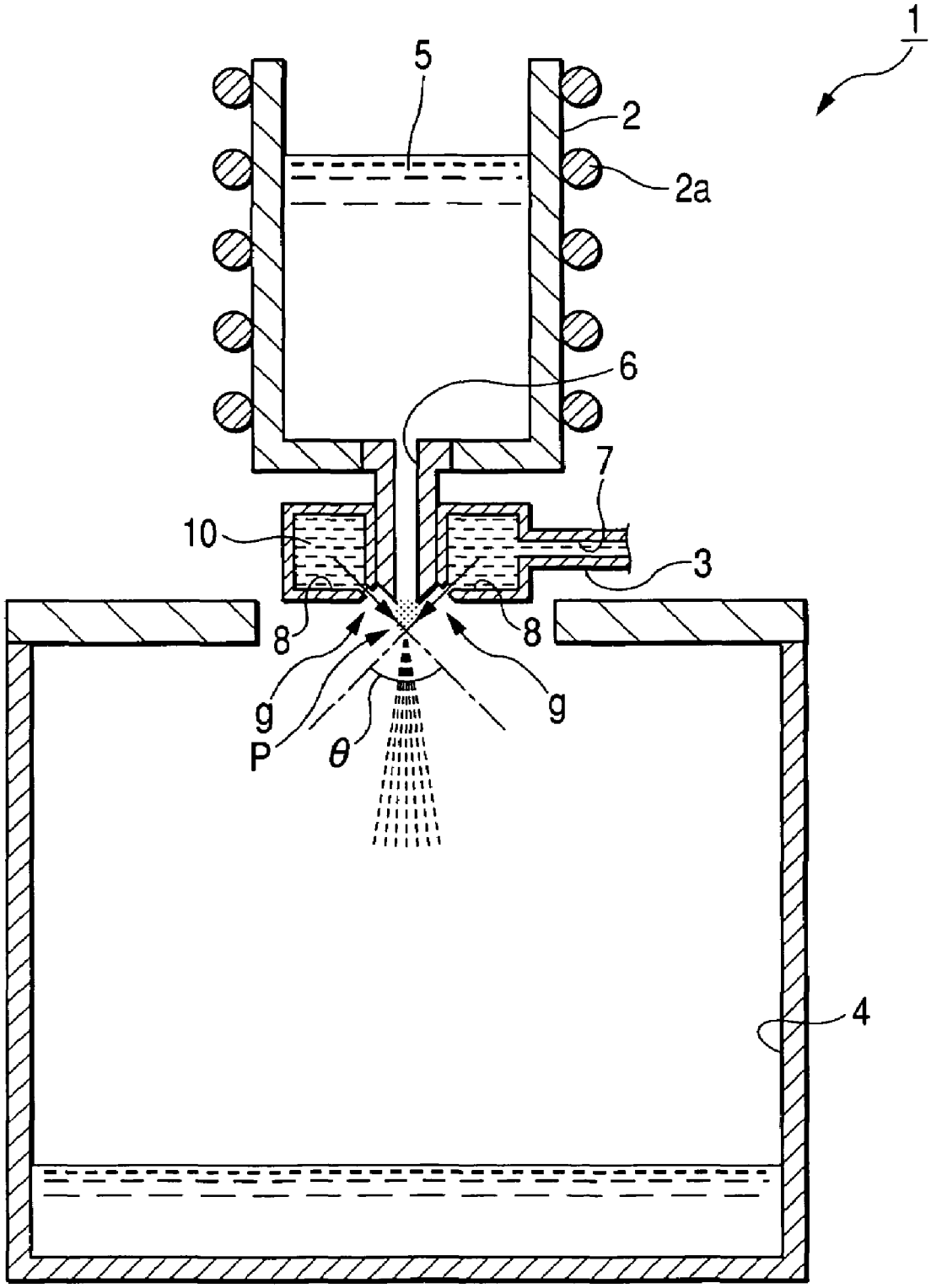
FIG. 1 is a sectional schematic view showing an example of a high-pressure water spraying device which is used for producing an amorphous soft magnetic alloy powder of the present invention.

Hereinafter, embodiments of the present invention will be described in detail.

(Embodiment of an Amorphous Soft Magnetic Alloy Powder)

An amorphous soft magnetic alloy powder according to this embodiment is an amorphous soft magnetic alloy powder manufactured by a water atomization method. Further, the powder includes Fe as a main element and at least P, C, B, Si, and is composed of an amorphous phase.

More specifically, the amorphous soft magnetic alloy powder is represented by following composition formula:

$$Fe_{100-a-b-x-y-z-w-t}Co_aNi_bM_xP_yC_zB_wSi_t$$

wherein M is one or two or more elements selected from Cr, Mo, W, V, Nb, Ta, Ti, Zr, Hf, Pt, Pd, and Au, with a, b, x, y, z, w and t representing composition ratios in a range of $0 \leqq x \leqq 3$, $2 \leqq y \leqq 15$, $0 \leqq z \leqq 8$, $1 \leqq w \leqq 12$, $0.5 \leqq t \leqq 8$, $0 \leqq a \leqq 20$, $0 \leqq b \leqq 5$ and $70 \leqq (100-a-b-x-y-z-w-t) \leqq 80$ in atomic %, respectively.

Since the amorphous soft magnetic alloy powder according to the embodiment includes Fe showing magnetism, and semimetal elements P, C, and B, which has an amorphous phase-forming ability, it is composed of an amorphous phase as a main phase and shows an excellent soft magnetic characteristic. Further, there is a need to add Si, in addition to the element P, C, and B.

Further, it is possible to enhance a corrosion resistance by adding an element M (one or two or more elements selected from Cr, Mo, W, V, Nb, Ta, Ti, Zr, Hf, Pt, Pd, and Au).

Further, in the amorphous soft magnetic alloy powder, a temperature interval ΔTx of a supercooled liquid as represented by ΔTx=Tx−Tg (wherein Tx is a crystallization initiation temperature and Tg is a glass transition temperature, respectively) is 20K or more. However, the ΔTx becomes 30K or more or 50K or more depending on a composition. Further, the amorphous soft magnetic alloy powder has excellent soft magnetic characteristics at room temperature.

The amorphous soft magnetic alloy powder is capable of increasing a magnetic characteristic compared to the conventional Fe—Al—Ga—C—P—Si—B-based alloy while keeping an amorphous phase-forming ability after the amorphous powder is produced. Further, it is possible to produce the amorphous soft magnetic alloy powder having a substantially spherical shape or a rugby ball shape by a water atomization method. Further, it is possible to obtain a corrosion resistance which is capable of enduring the process by the water atomization method. Further, it is possible to make the powder amorphous phase without the addition of the Ga, which reducing a manufacturing cost. Further, resultant powder can have a highly-saturated magnetism and a low core loss.

Further, since the amorphous soft magnetic alloy powder having a substantially spherical shape or a rugby ball shape according to the present invention is wholly composed of amorphous phase in whole composition thereof, in the case of heat-treatment under suitable condition, it is possible to reduce an internal stress without it being precipitated into a crystalline phase and to increase the soft magnetic characteristic still more.

Further, the amorphous soft magnetic alloy powder having a substantially spherical shape or a rugby ball shape according to the present invention, which is manufactured by the water atomization method can have the saturated magnetism which is equal to or more than that of the conventional spherical amorphous soft magnetic alloy powder, which is manufactured by the gas atomization method.

Since the amorphous soft magnetic alloy powder according to the present invention includes Fe, which is a ferromagnetic element, more than the conventional Fe—Al—Ga—C—P—Si—B-based alloy, it shows a highly-saturated magnetization. The saturated magnetization σs of the amorphous soft magnetic alloy powder can be improved by increasing the composition ration of the Fe.

An addition amount of the Fe is preferably 70 atomic % to 80 atomic %, more preferably 72 atomic % to 79 atomic %, most preferably 73 atomic % to 78 atomic %.

When the addition of Fe is less than 70 atomic %, the saturated magnetization σs decreases, and thus it not preferable. Further, when the addition of Fe exceeds 80 atomic %, a converted glassification temperature (Tg/Tm)(herein, Tm is a melting point of the alloy) representing a degree of amorphous phase-forming ability of the alloy becomes less than 0.54 and the amorphous phase-forming ability thereof decreases, and thus it is not preferable. In the formula, Tm represents a melting point of the alloy.

In the amorphous soft magnetic alloy powder, a part of the Fe contained therein can be substituted with Ni. The magnetic characteristic can be improved in the composition in which a part of the Fe is substituted with Co and Ni. For example, effect of improving the saturated magnetization and the DC superimposing characteristic can be obtained.

The substitution of the Co can be performed within an amount of 0 to 20 atomic % and the substitution of the Ni can be performed within an amount of 0 to 5 atomic %. The Co has an effect of increasing the Tc and the corrosion resistance. However, the substitution amount of the Co exceeds 20 atomic %, the amount of Fe decreases, the saturated magnetization becomes $180\times10^{-6}$ Wbm/Kg or less, Tc rises up to a temperature near Tg, and the thermal treatment becomes difficult, and thus it is not preferable. The Ni improves the corrosion resistance (Ni has the highest corrosion resistance among ferromagnetic elements). However, when the substitution amount of the Ni exceeds 6 atomic %, the saturated magnetization decreases.

C, P, B, and Si are elements increasing the amorphous phase-forming ability. When these elements are added into the Fe and the element M to make a multi-element, it is stabilized compared to the case that it is composed of two elements of Fe and the M described above, and thus an amorphous phase is formed.

Specifically, since P has a eutectic composition with Fe at a low temperature (about 1050° C.), the whole structure becomes an amorphous phase and the temperature interval ΔTx of the supercooled liquid is easily realized.

Further, P and Si are added at the same time, the temperature interval ΔTx of the supercooled liquid is enlarged, the amorphous phase-forming ability is improved, and the manufacturing condition at the time of obtaining the amorphous single phase structure can be relaxed toward a relatively easy direction.

When the composition ratio 'y' exists within the above-described range, the temperature interval ΔTx of the supercooled liquid is increased and the amorphous phase-forming ability of the alloy powder is improved.

Further, the element M, which is represented by Cr, Mo, W, V, Nb, Ta, Ti, Zr, and Hf, can form the passive film onto the alloy powder and improve the corrosion resistance of the alloy powder. Among these elements, Cr is most effective in improving the corrosion resistance. The above-described element can prevent a corroded portion from being generated while the molten alloy directly contact with water in the water atomization method, or during the drying process of the alloy powder (a visual level). Furthermore, these elements may be added independently or may be added compositely by a mixture of two or more elements, for example, the elements may be added compositely with a compound such as Mo and V; Mo and Cr; V and Cr; Cr, Mo and V, etc. Among these elements, Mo and V are inferior to Cr in corrosion resistance. However, since the amorphous phase-forming ability is improved, these elements are selected as it needed. Further, when the addition amount of element selected from Cr, Mo, W, V, Nb, and Ta exceeds 8 atomic %, the magnetic characteristic (saturated magnetization) deteriorates.

Zr and Hf have the highest glass-forming ability among the elements employed as the element M in the above-described compositional formula. Since Ti, Zr, and Hf are strong oxidizers, if the addition amount of these elements exceeds 8 atomic %, when the alloy powder raw material is dissolved under the atmosphere, the molten alloy is oxidized during oxidization of the raw material and the magnetic characteristic (saturated magnetization) deteriorates. These elements attribute to the formation of the passive film and improve the corrosion resistance.

Further, the effect of improving the corrosion resistance as the amorphous soft magnetic alloy powder is obtained by the addition of one or two or more noble metals selected from Pt, Pd, and Au. The corrosion resistance is improved by dispersing the noble metal at the surface of the powder. These noble metal elements may be added independently or may be added compositely with an association with the element such as Cr having the effect of improving the corrosion resistance. The noble metal elements are not mixed with Fe. Therefore, when the addition amount of the noble metal elements exceeds 8 atomic %, the glass-forming ability deteriorates and the magnetic characteristic (saturated magnetization) also deteriorates.

For giving the corrosion resistance to the amorphous soft magnetic alloy powder, it is necessary that the addition amount of the element M is 0.5 atomic % or more.

Therefore, M in the above-described composition formula is one or two or more elements selected from Cr, Mo, W, V, Nb, Ta, Ti, Zr, Hf, Pt, Pd and Au. Specifically, it is preferable to use one or two or more elements selected from Cr, Mo, W, V, Nb, and Ta. It is preferable that the composition ratio 'x' of M be 3 atomic % or less.

Since the thermal stabilization is improved due to the addition of Si, it is preferable that Si is added in an amount of 0.5 atomic % or more. When the addition amount of Si exceeds 8 atomic %, the melting point thereof is increased. Therefore, it is necessary that the composition ratio 't' of Si is set within a range of 0.5 atomic % to 8 atomic %. The addition amount of Si is preferably 2 atomic % to 8 atomic %, and more preferably 3 atomic % to 7 atomic %.

Si is an especially important element in the amorphous soft magnetic alloy powder according to this embodiment. Si prevents the amorphous soft magnetic alloy powder from being corroded while the molten alloy is quenched by the water atomization method under an atmosphere in which water exists and becomes an amorphous alloy, in addition to the above-described elements exhibiting corrosion-resistance improving effects.

Specifically, when the molten alloy is quenched by the water atomization method, a large amount of water exists at the periphery of the liquid droplets of a high temperature molten alloy, and a large amount of an element such as Fe, which is easily corroded by the water, is included in the liquid droplets. Therefore, when the amorphous soft magnetic alloy powder is made of a Fe—M—P—C—B-based molten alloy simply by the water atomization method, the alloy powder is apt to become an amorphous soft magnetic alloy powder which has a rust color due to the corrosion of Fe. Further, when the corrosion occurs, the magnetic characteristic thereof deteriorates. On the contrary, when the amorphous soft magnetic alloy powder includes Si with a predetermined amount in addition to the above-described element for improving the corrosion resistance property, Si concentrates on a portion adjacent to the outermost surface of the powder particles as a high-concentration thin layer and serves as a passive film. Thus, Si serves as a corrosion resistant barrier of the elements which exist inside of the Si barrier and are easily corroded. Since a passive film of Si exists on the surface portion of powder particles, even though the molten alloy is quenched by the water atomization method under the atmosphere in which a high concentration of water exists and the temperature of the molten alloy is high, it is possible to prevent an element such as Fe, which is easily corroded, from being corroded, the amorphous soft magnetic alloy powder which is obtained does not become rust colored, and the soft magnetic characteristic does not deteriorate.

Next, when the addition amount of B is less than 1 atomic %, it is difficult to obtain the amorphous soft magnetic alloy powder. Further, when it exceeds 12 atomic %, the melting point is raised. Therefore, the composition ratio 'w' of B is preferably 1 atomic % to 12 atomic %, more preferably 2 atomic % to 10 atomic %, and most preferably 4 atomic % to 9 atomic %.

Further, since the thermal stability is improved due to the addition of C, it is preferable to add C. When the addition amount of C exceeds 8 atomic %, the melting point is raised. Therefore, the composition ratio 'z' of C is preferably 8 atomic % or less with it exceeding 0 atomic %, more preferably 6 atomic % or less with it exceeding 0 atomic %, and most preferably 1 atomic % to 4 atomic %.

The total composition ratio (y+Z+w+t) of the semimetal element of C, P, B, and Si is preferably 17 atomic % to 25 atomic %, and more preferably 18 atomic % to 25 atomic %.

When the total composition ratio of the semimetal element exceeds 25 atomic %, especially, the composition ratio of Fe relatively decreases, the saturated magnetization $\sigma s$ decreases, and the hardness excessively increases. Therefore, the consolidation is difficult at the time of compacting, and thus it is not preferable. When the total composition ratio of the semimetal elements is less than 17 atomic %, the amorphous phase-forming ability deteriorates, and it is difficult to obtain a single phase structure of amorphous phase.

The amorphous soft magnetic alloy powder according to the present invention may contain 4 atomic % or less of Ge in the above-described composition.

In any composition of the invention described above, the temperature interval $\Delta Tx$ of a supercooled liquid becomes 20K or more, and 35K or more depending on the composition.

Further, inevitable impurities may be contained, in addition to the elements represented by the above-described composition.

As described above, the amorphous soft magnetic alloy powder with the above-described composition obtained by the water atomization method has magnetism at room temperature, and shows a more excellent magnetism by thermal treatment. Therefore, the amorphous soft magnetic alloy powder can be utilized in various applications, as a material having excellent soft magnetic characteristics.

Next, an aspect ratio of the amorphous soft magnetic alloy powder of the present invention is preferably 1 to 3.5, more preferably 1 to 3, and further more preferably 1.2 to 2.5. When the average of the aspect ratio exceeds 3.5, the amount of amorphous powder increases and forming density thereof decreases. Further, when the amorphous soft magnetic alloy powder is used as a magnetic core, the magnetic permeability thereof decreases, the DC superimposing characteristic deteriorates, and when it is made into a formed body, it is difficult to obtain an insulating property of powder. Further, when the average of the aspect ratio is 1.3 or more, the demagnetizing field of the powder decreases and the magnetic permeability of the core increases.

Further, the average particle diameter (D50) of the amorphous soft magnetic alloy powder of the invention is preferably 30 μm or less, more preferably 5 μm to 30 μm, and most preferably 9 μm to 19 μm. When D50 exceeds 30 μm, an eddy current is generated in the powder particles, and the core loss increases. When the particle diameter D50 increases beyond 30 μm, the shape of the powder is slowly changed into an abnormal shape, which leads to the decrease of the forming density, the magnetic permeability of the magnetic core, the deterioration of the DC superimposing characteristic. Further, D50 is less than 5 μm, the demagnetizing field of the powder increases, the magnetic permeability of the magnetic core and the powder decrease, and the oxygen concentration increases.

Further, the tap density of the amorphous soft magnetic alloy powder of the invention is preferably 3.7 $Mg/m^3$ or more, more preferably 3.8 $Mg/m^3$ or more, and most preferably 3.9 $Mg/m^3$ or more. When the tap density is high, the density of the magnetic core increases, and at the same time, the magnetic permeability of the magnetic core and the DC superimposing characteristic is improved, and the strength of the formed body increases.

Further, the oxygen concentration of the amorphous soft magnetic alloy powder of the present invention is preferably 3000 ppm or less on the reason described above, is more preferably 2500 ppm or less, and most preferably 2000 ppm or less. When the oxygen concentration increases, rust is easily generated at the surface due to the corrosion, the magnetic characteristic of the powder deteriorates, the loss of the magnetic core increases, and the magnetic permeability decreases.

Further, the specific surface area of the amorphous soft magnetic alloy powder according to the present invention is preferably 0.40 $m^2/g$ or less, more preferably 0.38 $m^2/g$, and most preferably 0.35 $m^2/g$. In the powder having a wide specific surface area, an unevenness increases in the powder shape, and the oxygen concentration of the powder having a high specific area increases. When the specific surface area is high, it is difficult to obtain the insulating property between the powders, the forming density of the magnetic core decreases. Further, the magnetic permeability and the direct current overlay property also decrease.

(Method of Producing an Amorphous Soft Magnetic Alloy Powder by Using a Water Atomization Method)

Hereinafter, an example of the method of producing the amorphous soft magnetic alloy powder by using the water atomization method will be described.

The water atomization method utilized to the present invention comprises the steps of spraying the amorphous soft magnetic molten alloy into the inside of a chamber in the shape of mist by using high-pressure water flow under an atmosphere of air, which has a composition which is the same or almost the same as that of the above-described amorphous soft magnetic alloy powder, and grinding and quickly quenching the molten alloy to produce the amorphous soft magnetic alloy powder having a substantially spherical shape or rugby ball shape.

FIG. 1 is a schematic sectional view showing an example of a high-pressure water spraying device which is suitably used for producing an alloy powder by the water atomization method.

The high-pressure water spraying device 1 mainly comprises a molten metal crucible 2 disposed at the upper side of the device, a water sprayer 3 disposed under the crucible 2, and a chamber 4 disposed under the water sprayer 3. The high-pressure water spraying device 1 is disposed under an atmosphere of air when it is used.

A molten alloy 5 is filled inside the molten metal crucible 2. Further, the molten metal crucible 2 is provided with an induction heating coil 2*a* as heating means. The induction heating coil 2*a* heats the molten alloy 5 to maintain it in a molten state. Further, a molten metal nozzle 6 is disposed at the lower side of the molten metal crucible 2 and the molten alloy 5 is dropped toward the inside of the chamber 4 from the molten metal nozzle 6.

The water sprayer 3 is disposed at the periphery of the molten metal nozzle 6 under the molten metal crucible 2. The water sprayer 3 is provided with a water-induction flow passage 7 and a water spraying nozzle 8 that is a water spraying portion having a circular shape of the water-induction flow passage 7.

Further, high-pressure water 10, which is pressured by a liquid pressuring pump (pressuring means) not shown, is induced to the water spraying nozzle 8 via the induction flow passage 7 and sprayed toward the inside of the chamber 4 as high-pressure water flow g from the nozzle 8.

The inside of the chamber 4 is kept in the atmospheric pressure which is the same as the peripheral circumstance of the high-pressure water spraying device 1. The pressure inside the chamber 4 is maintained to a pressure of about 100 kPa and the temperature thereof is maintained at about room temperature.

For producing an amorphous soft magnetic alloy powder having a substantially spherical shape or rugby ball shape, the molten alloy 5 filled in the molten metal crucible 2 is dropped to the inside of the chamber 4 from the molten metal nozzle 6. At the same time, the high-pressure water 10 is sprayed from the water spraying nozzle 8 of the water sprayer 3. The sprayed high-pressure water 10 reaches the dropped molten alloy as a high-pressure water flow g, collides with the molten alloy at the spraying point p, and quenches and solidifies the molten alloy while making the molten alloy into mists. The amorphous soft magnetic alloy powder comprising an amorphous phase of the above-described composition having a substantially spherical shape or a rugby ball shape is produced and stored with water in the bottom of the chamber 4.

Here, the cooling rate of the molten alloy is set to a degree in which surface tension acts sufficiently on the molten alloy. The cooling rate of the molten alloy is suitably determined depending on a composition of the alloy, a particle diameter of the alloy powder and the like. The guidepost can be set within a range of $10^3$ to $10^5$ K/s. Further, the cooling rate can be suitably selected by confirming that the powder having the shape close to the substantially spherical shape or the rugby ball shape is actually obtained or not, and by confirming that a phase such as $Fe_3B$, $Fe_2B$, and $Fe_3P$ as a crystalline phase is precipitated or not in a glassy phase.

Next, these powders having the substantially spherical shape or the rugby ball shape are dried by heating under an atmosphere of air and can be sorted to obtain the amorphous soft magnetic alloy powder as a product of a spherical shape, a substantially spherical shape, or a rugby ball shape, which has a predetermined average particle diameter.

When the amorphous soft magnetic alloy powder is produced by the water atomization method, the cooling rate of the molten alloy is controlled by controlling a spraying pressure of water, a spraying flow rate of water, a flow rate of the molten alloy, etc., and the producing condition is controlled by controlling a slit width of the water spraying nozzle, an inclination angle of the water spraying nozzle, a water spraying angle, a temperature or a viscosity of the molten alloy, an atomizing point (pulverization point distance), etc., and thus the amorphous soft magnetic alloy powder having targeted characteristics, specifically, the aspect ratio, the tap density, D50, the concentration of the oxygen, etc. within the above-described range is obtained.

The obtained amorphous soft magnetic alloy powder may be heat-treated as needed. The internal stress of the alloy powder is relaxed by the heat treatment, and the soft magnetic characteristic of the amorphous soft magnetic alloy powder can be further improved. The heat-treatment temperature Ta is preferably within a range of a Curie temperature Tc to a glass transition temperature Tg. When the heat-treatment temperature Ta is less than the Curie temperature Tc, since the effect of improving soft magnetic characteristics by the heat treatment is not obtained, and thus it is not preferable. Further, when the heat-treatment temperature Ta exceeds the glass transition temperature Tg, since a crystalline phase is easily precipitated inside the alloy powder structure and the soft magnetic characteristic may deteriorate, and thus it is not preferable.

Further, it is preferable that the heat-treatment time is set within a range in which the internal stress of the alloy powder can be sufficiently relaxed and the precipitation of the crystalline phase rarely occurs, for example, a range of 30 to 300 minutes.

Since it is possible to produce the amorphous soft magnetic alloy powder according to this embodiment by the water atomization method, a large-scaled manufacturing apparatus can be implemented. Further, it is possible to pulverize the molten alloy by high-pressure water flow, the mass productivity can be improved. Furthermore, since it is possible to produce the amorphous soft magnetic alloy powder without using a highly-priced inert gas under the atmosphere, manufacturing cost can be reduced.

Further, the amorphous soft magnetic alloy powder according to this embodiment has the substantially spherical shape or the rugby ball shape through the water atomization method, and thus the bulk density thereof is high and the surface-unevenness of the powder is little, whereby the forming density can be increased. Further, when the powder is mixed with an insulating material such as a resin, and solidified and molded for fabricating the dust core, an insulating property can be maintained between powders, and thus the produced powder is useful as the soft magnetic alloy powder for fabrication the dust core.

Further, since the amorphous soft magnetic alloy powder has substantially the spherical shape or the rugby ball shape, when the amorphous soft magnetic alloy powder is processed by an attritor, etc. for manufacturing a wave absorber, flattened particles having a uniform shape can be easily obtained. Further, it is easy to control the particle diameter, and thus it is useful as the soft magnetic alloy powder for fabrication of the wave absorber.

(Embodiment of a Flat Amorphous Soft Magnetic Alloy Powder)

The flat amorphous soft magnetic alloy powder according to this embodiment is obtained by flattening the above-described amorphous soft magnetic alloy powder having the substantially spherical shape or the rugby ball shape according to any one of embodiments.

Here, a method for flattening amorphous soft magnetic alloy powder comprises, for example, charging the above-described amorphous soft magnetic alloy powder having the substantially spherical shape or the rugby ball shape according to the embodiment into the attritor, and grinding and mixing within a time of ten minutes to sixteen hours, thereby obtaining the amorphous soft magnetic alloy powder mainly composed of a flattened amorphous soft magnetic alloy powder. Here, it is preferable that the amorphous soft magnetic alloy powder before flattening is not heat treated.

The grinding and mixing time by the attritor is preferably ten minutes to sixteen hours, more preferably four hours to eight hours.

When the grinding and mixing time is less than ten minutes, the flattening is not sufficient, and thus the aspect ratio of 1 or more, for example, 10 or more can not be obtained. When the grinding and mixing time exceeds sixteen hours, the aspect ratio of the flat amorphous soft magnetic alloy powder exceeds 80. The thickness of the flat amorphous soft magnetic alloy powder is preferably 0.1 to 5 μm (more preferably 1 to 2 μm), and the length thereof is preferably 1 to 80 μm (more preferably 2 to 80 μm).

The obtained flat amorphous soft magnetic alloy powder may be heat-treated if it is necessary, like the above-described embodiment.

Since the amorphous soft magnetic alloy powder having a spherical shape in which the unevenness is little is used to produce the flat amorphous soft magnetic alloy powder according to this embodiment, the amorphous alloy powder is not powdered into fine particles and it is possible to flatten the amorphous alloy into the flat amorphous soft magnetic alloy powder with a uniform shape. Thus, a flattened powder having a predetermined shape is obtained. When the flat amorphous soft magnetic alloy powders are mixed with an insulating material such as a resin for manufacturing the wave absorber, etc., these powders are arranged in parallel to each other in the shape of a layer, and thus it is possible to compactly fill the powders and to make gap between the flattened powders small.

(Embodiment of a Dust Core)

The dust core (pressed powder magnetic core) according to the invention is obtained by mixing one or more amorphous soft magnetic alloy powders having a substantially spherical shape or a rugby ball shape according to the above-described embodiment, an insulating material, the insulating material serves as a binder and a lubricant; granulating the resultant mixture into a granulated powder; and solidifying and molding the granulated powder.

Figure 2:
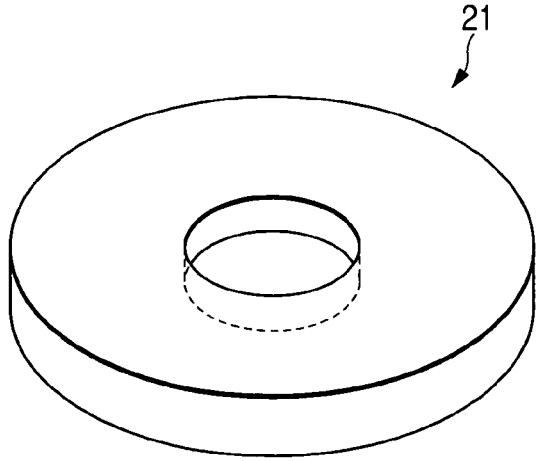
FIG. 2 is a perspective view illustrating a first embodiment of a dust core of the invention.

As a shape of the dust core, for example, an annular dust core 21 as shown in FIG. 2 can be exemplified. However, the shape is not limited thereto, the shape may be an elliptically annular shape or an elliptical shape. Further, the shape may be a substantially E-shape, substantially U-shape, or substantially I-shape in a plain view.

The granulated powder is bonded to each other by the insulating material to produce the dust core. In the structure of the granulated powder, single or a plurality of amorphous soft magnetic alloy powder exist. The amorphous soft magnetic alloy powder is not melted to constitute a uniform structure. Further, it is preferable that each of the amorphous soft magnetic alloy powders in the granulated powder is insulated from each other by the insulating material.

As described above, since the amorphous soft magnetic alloy powder and the insulating material exist in the dust core 21 in a state they are mixed, a specific resistance of the dust core itself increases depending on the insulating material and the decrease in eddy-current loss decreases. Therefore, the decrease of the magnetic permeability in a high frequency region is reduced.

Further, in case that the temperature interval ΔTx of the supercooled liquid of the amorphous soft magnetic alloy powder is less than 20K, it is difficult to sufficiently relieve the internal stress of the granulated powder without being crystallized at the time of performing a heat treatment after the granulated powder made by mixing the amorphous soft magnetic alloy powder and the insulating material is compressed and formed.

It is preferable that the insulating material used to constitute the dust core of this embodiment is composed of a material which is capable of increasing the specific resistance of the dust core, of forming a granulated powder containing the amorphous soft magnetic alloy powder, and of maintaining the shape of the dust core by binding the formed granulated powder, and which does not cause significant losses in magnetic characteristics. As the insulting material, a liquid or powdered resin or a rubber such as an epoxy resin, a silicone resin, a acrylic resin, a silicone rubber, a phenol resin, a urea resin, a melamine resin, and PVA (polyvinyl alcohol), a water glass ($Na_2O$—$SiO_2$), oxide glass powder ($Na_2O$—$B_2O_3$—$SiO_2$, PbO—$B_2O_3$—$SiO_2$, PbO—BaO—$SiO_2$, $Na_2O$—$B_2O_3$—ZnO, CaO—BaO—$SiO_2$, $Al_2O_3$—$B_2O_3$—$SiO_2$, $B_2O_3$—$SiO_2$), glassy material (comprising $SiO_2$, $Al_2O_3$, $ZrO_2$, $TiO_2$, etc. as a main component) which is produced by a sol-gel method, etc., can be exemplified.

As the insulating material, various elastomers (rubbers) may be used. Further, a lubricant selected from stearates (zinc stearate, calcium stearate, barium stearate, magnesium stearate, aluminum stearate, etc.) is simultaneously used with the insulating material. Of the above-described insulating materials, the silicone resin or the silicone rubber is particularly preferably used.

From the same reason as above, the particle diameter of the granulated powder used in the dust core 21 of this embodiment is preferably 45 μm to 500 μm, more preferably 45 μm to 300 μm, and most preferably 45 μm to 150 μm.

The content of the granulated powder having the particle diameter of 45 μm to 500 μm is preferably 83% by weight or more, or the content (incorporated amount) of the granulated powder having the particle diameter of less than 45 μm and more than 500 μm is preferably 17% by weight or less, and more preferably 15% by weight or less with regard to the total amount of the granulated powder constituting the dust core 1 in that the fluidity of the granulated pressed powder is excellent when it flows into a metal mold for manufacturing the dust core and the mass productivity is improved.

When the dust core (compressed powder magnetic core) according to this embodiment is manufactured by using an amorphous soft magnetic alloy powder of which D50 is 5 to 30 μm, a tap density is 3.7 $Mg/m^3$ or more, a specific surface area is 0.35 $m^2/g$ or less, and an oxygen concentration is 3000 ppm or less, as an alloy composition which shows magnetic characteristics in which saturated magnetization σs is $180\times10^{-6}$ Wbm/Kg or more and a coercive force Hc is 10 A/m or less, the dust core has W of 400 $kW/m^3$ or less at 100 kHz, 0.1 T, and a constant magnetic permeability (μ') of 60 to 100 at 1 MHz or less, and shows μ (DC=5500 A/m) of 35 to 40.

Next, an example of the dust core of this embodiment will be described with reference to appended drawings.

The method of manufacturing the dust core of this invention comprises the steps of forming a granulated powder by mixing the amorphous soft magnetic alloy powder having a substantially spherical shape or rugby ball shape according to the embodiment which is obtained by the water atomization method, an insulating material, and a lubricant and granulating the resultant mixture into the granulated powder; forming a core precursor by a compression molding the granulated powder; and removing the internal stress of the core precursor by performing a heat treatment on the core precursor at a temperature within a range of Tc to Tg.

In the step of forming the granulated powder, the mixing ratio of the insulating material in the mixture of the amorphous soft magnetic alloy powder, the insulating material, and the lubricant is preferably 0.3% by weight to 5% by weight, and more preferably 1% by weight to 3% by weight.

In the case that the mixing ratio of the insulating material is less than 0.3% by weight, it is difficult to make the mixture of the amorphous soft magnetic alloy powder, the insulating material, and the lubricant with a predetermined shape, and thus it is not preferable. Further, in case that the mixing ratio of the insulting material exceeds 5% by weight, the addition density of the amorphous soft magnetic alloy powder in the granulated powder decreases, and as a result, the content of the amorphous soft magnetic alloy powder in the dust core manufactured by using the granulated powder decreases, and the soft magnetic characteristic of the dust core deteriorates, and thus it is not preferable.

Further, the mixing ratio of the lubricant in the above-described mixture is preferably 0.1% by weight to 2% by weight, and more preferably 0.1% by weight to 1% by weight.

In the case that the mixing ratio of the lubricant is less than 0.1% by weight, the fluidity of the amorphous soft magnetic alloy powder is not greatly improved, and thus the efficiency of manufacturing the granulated powder cannot be greatly expected and the addition density of the amorphous soft magnetic allow powder in the granulated powder decreases. As a result, the soft magnetic characteristics of the dust core deteriorate, and thus it is not preferable. Further, in case that the mixing ratio of the lubricant exceeds 2% by weight, the addition density of the amorphous soft magnetic alloy powder in the granulated powder decreases and the mechanical strength of the dust core deteriorates, and thus it is not preferable.

For forming the granulated powder, the formed granulated powder is sorted, and a granulated powder having a particle diameter within a range of preferably 45 μm to 500 μm, more preferably 45 μm to 300 μm, and most preferably 45 μm to 150 μm is selected, and it is used in a post-step. At the sorting step, a sieve, a vibrating sieve, a sonic sifter, and an air-flow classifier may be used.

Next, an embodiment of forming the magnetic core precursor by a compression molding the granulated powder will be described.

It is preferable that the solvent, water and the like contained in the granulated powder are vaporized and the insulating material layer is formed at the surface of the amorphous soft magnetic alloy powder before the compression molding step.

Figure 3:
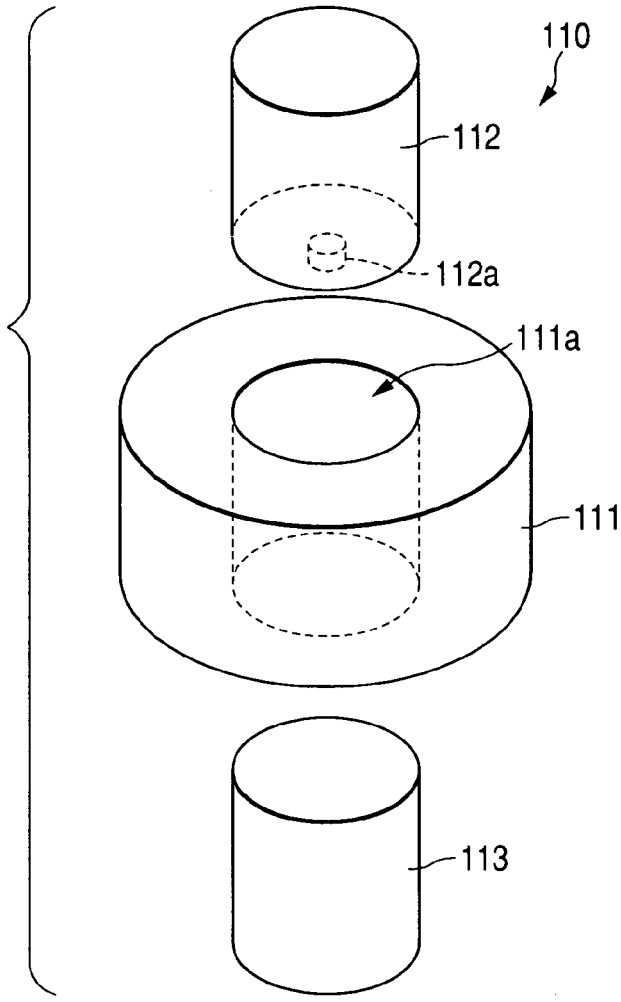
FIG. 3 is an exploded perspective view showing an example of a metal mold which is used for producing the dust core of the invention.

The granulated powder is compressed and molded to form a magnetic core precursor. A metal mold 110 shown in FIG. 3 is used for manufacturing the core precursor. The metal mold 110 comprises a hollow cylindrical die 111, an upper punch 112 which is fitted into a cylindrical part 111*a* of the die 111, and a lower punch 113.

A cylindrical protrusion 112*a* is disposed on a lower surface of the upper punch 112. When the upper punch 112, the lower punch 113, and the die 111 are incorporated, an annular mold is formed inside the metal mold 110. The above-described granulated powder is filled into the metal mold 110.

Next, the compression molding is performed by heating the granulated powder filled in the metal mold 110 to a room temperature or a predetermined temperature while applying uniaxial pressure thereto.

Figure 4:
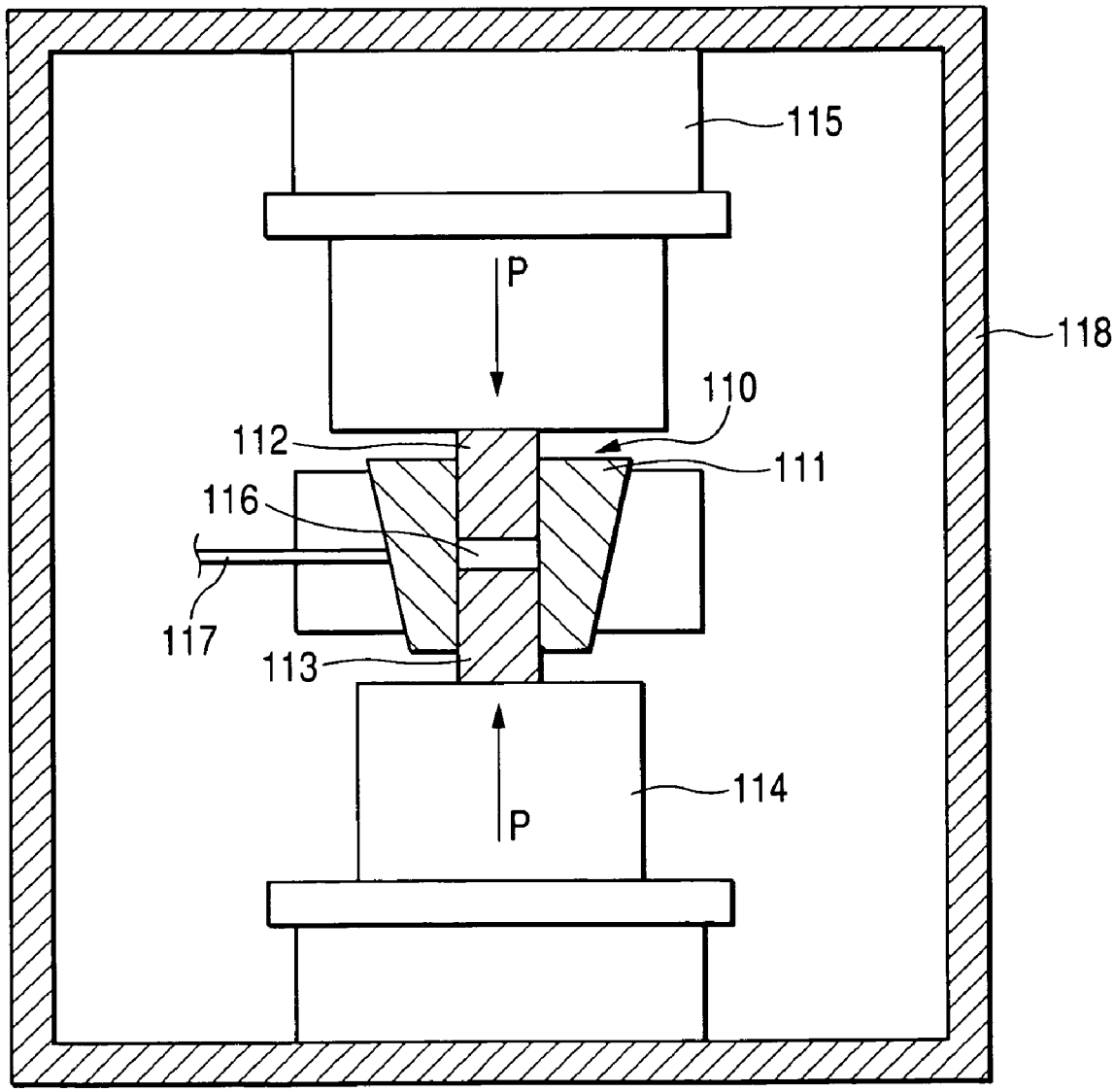
FIG. 4 is a schematic view showing a principal part of a discharge plasma sintering apparatus which is used for producing the dust core of the present invention.

FIG. 4 shows a principle part of a discharge plasma sintering apparatus which is appropriate for using at the time of a compression molding.

The discharge plasma sintering apparatus comprises a metal mold 110 in which the mixture is filled, a punch electrode 114 which supports a lower punch 113 of the metal mold 110 and which also serves as one electrode while a pulsed current to be described flows, a punch electrode 115 which presses an upper punch 112 of the metal mold 110 toward the lower side and which serves as another electrode while the pulsed current flows, and a thermocouple 117 which measures the temperature of the granulated powder in the metal mold 110, as main components.

The discharge plasma sintering apparatus is received in a chamber 118. The chamber 118 is connected to a vacuum pumping system and an atmosphere gas-supplying apparatus not shown. The chamber 118 is constructed such that the granulated powder filled in the metal mold 110 is kept under a desired atmosphere such as inert gas atmosphere. Although a current-carrying device is not shown in FIG. 4, an additional current-carrying device is connected to the upper and lower punches 112 and 113, and the punch electrodes 114 and 115, and thus pulsed current can flow from the current-carrying device through the punches 112 and 113 and the punch electrodes 114 and 115.

The metal mold 110 in which the granulated powder is filled is disposed at the discharge plasma sintering apparatus, the inside of the chamber 118 is vacuumed, uniaxial pressure P is applied to a mixture from the punches 112 and 113 in up and down directions, and the pulsed current is applied to the mixture, and thus the granulated powder is compressed and molded while being heated.

The discharge plasma sintering apparatus is capable of raising a temperature of the granulated powder in a rapid speed by the current and of reducing the compression molding time, and thus it is possible to compaction-mold the granulated powder while keeping the amorphous phase of the amorphous soft magnetic alloy powder.

In the temperature at the time of compression molding the above-described granulated powder of the present invention, when the granulated powder is compressed and molded at a temperature within a range of 373K (100° C.) to 673K (400° C.), the insulating material is suitably hardened. Thus, it is possible to make the granulated powder have a predetermined shape by bonding the granulated powders each other.

Further, for example, uniaxial pressure P which is applied to the granulated powder at the time of compression molding is preferably set to a range of 600 MPa to 1500 MPa. By doing so, an annular magnetic core precursor is obtained.

Further, in case that the granulated powder filled in the metal mold 110 is compressed and molded at room temperature while applying the uniaxial pressure P, an annular magnetic core precursor can be manufactured by using a press device having the same configuration as that of the apparatus shown in FIG. 4, except that the current-carrying device is not connected thereto.

In the case that the silicone rubber is used as the insulating material, the magnetic core precursor having a predetermined shape can be obtained by a compression molding the granulated powder at room temperature at the time of the above-described molding step. The silicone rubber has elasticity, and thus the hardening stress thereof is small, and the internal stress remaining in the amorphous soft magnetic alloy powder is small. Therefore, an influence of the magnetostriction is removed and thus the soft magnetic characteristic of the amorphous soft magnetic alloy powder is improved. Thus, it is possible to significantly reduce the coercive force and the core loss of the dust core.

In the case that the silicone rubber is used as the insulating material, when the pressure applied to the granulated powder at the time of compression molding is too low, it is difficult to raise the density of the dust core and to form a closely packed dust core. Further, when the pressure is too high, the die and punches is rapidly consumed and it is necessary to heat-treat the granulated powder for a long time for removing stress generated at the time of molding. Therefore, the pressure is preferably set within a range of 500 MPa to 2500 MPa.

Next, the heat-treatment step of removing the internal stress of the core precursor by heat-treating the core precursor will be described.

When the core precursor is heat-treated within a predetermined temperature range, it is possible to remove an internal stress of the core precursor itself generated during the powder producing process and the molding process, and an internal stress of the amorphous soft magnetic alloy powder contained in the core precursor and it is also possible to manufacture the dust core of which coercive force is low. The temperature of the heat-treatment is preferably set within a range of Tc to Tg.

The dust core 21 thus obtained comprises the amorphous soft magnetic alloy powder of this embodiment, and thus the dust core 21 has an excellent soft magnetic characteristic at room temperature and has a more excellent soft magnetic characteristic by a heat-treatment.

Therefore, the dust core of materials having excellent soft magnetic characteristics can be applied to a magnetic core of various magnetic devices, and it is possible to obtain a magnetic core having excellent soft magnetic characteristics as compared to the conventional materials.

The dust core according to this embodiment is manufactured by solidification-forming an granulated powder, which is produced by using an amorphous soft magnetic alloy powder of which soft magnetic characteristics are excellent, a bulk density is high, a surface unevenness is small, and a shape is nearly spherical. Therefore, it is possible to increase the forming density of the dust core, to maintain the insulation between powders, and to improve the magnetic characteristics.

Further, since the amorphous soft magnetic alloy powder of this embodiment which is produced by the water atomization method is used, the mass productivity can be enhanced.

The lubricant is added during the step of manufacturing the granulated powder, not after the granulated powder is manufactured. Therefore, the slidability between the amorphous soft magnetic alloy powders at the time of manufacturing the granulated powder is excellent, a manufacturing efficiency of the granulated powder can be improved. Further, the amorphous soft magnetic alloy powder can be contained closely in the granulated powder, the density of the granulated powder increases. As a result, the dust core having excellent soft magnetic characteristics can be obtained.

(Embodiment of a Wave Absorber)

The wave absorber according to the embodiment of the invention is composed of a mixture of the flat amorphous soft magnetic alloy powder and the insulating material according to this embodiment. The plurality of the flat amorphous soft magnetic alloy powders, which are added to the wave absorber, are arranged in parallel to each other and in the form of a layer in the insulating material.

As the insulating material which is used in this embodiment, a material which has an insulating property and which serves as a binder is used. As the insulating material, a thermoplastic resin such as vinyl chloride, polypropylene, an ABS resin, a phenol resin, chlorinated polyethylene, a silicone resin and a silicone rubber can be selected. Among these thermoplastic resins, the chlorinated polyethylene is most preferable from the standpoint of workability.

The chlorinated polyethylene which shows an intermediate characteristic between polyethylene and polyvinyl chloride and which has characteristics such as a chlorine content of 30 to 45%, an elongation of 420 to 800%, and a Mooney viscosity of 35 to 75 (Ms1+4: 100° C.) can be used.

Further, another type of the wave absorber of the invention is made by at least mixing the flat amorphous soft magnetic alloy powder and a binder composed of a silicone elastomer, and solidifying and molding the resultant mixture into in the form of a sheet.

Further, a lubricant composed of aluminum stearate may be added to the wave absorber, in addition to the flat amorphous soft magnetic alloy powder of this embodiment and the resin as the binder. Further, a silane coupling agent may also be added thereto.

Further, in the wave absorber, the flat amorphous soft magnetic alloy powders of this embodiment are solidified and molded with a resin as a binder, and thus the flat amorphous soft magnetic alloy powders of this embodiment have a structure which they are dispersed in the resin and are arranged in parallel to each other and in the form of a layer in the resin.

Further, in the another wave absorber, the flat amorphous soft magnetic alloy powders of this embodiment are solidified and molded with a binder composed of a silicone elastomer, and thus the flat amorphous soft magnetic alloy powders of this embodiment have a state which they are dispersed and arranged in parallel to each other and in the form of a layer in the binder. Specifically, it is preferable that each flat amorphous soft magnetic alloy powder is insulated by the silicone elastomer.

As described above, since the flat amorphous soft magnetic alloy powders of this embodiment are insulated by a resin binder, the impedance of the wave absorber itself increases, and thus the generation of the eddy current is suppressed, an imaginary part μ" (hereinafter referred to as an imaginary magnetic permeability μ") of a complex magnetic permeability in a frequency band of several hundreds MHz to several GHz can be increased in a wide range. Further, it is possible to improve the effect of electromagnetic suppression in a high frequency band.

In the above-described wave absorber which is made by using a thermoplastic resin as a binder, the imaginary magnetic permeability μ" thereof in the 1 GHz range is 6 or more. When the imaginary magnetic permeability μ" is 6 or more, the effect of electromagnetic suppression in the GHz band is improved, and the unnecessary high frequency electric wave can be effectively absorbed, and thus it is preferable. Further, in case that a soft binder is selected as the binder, a soft wave absorber can be obtained. For example, it is possible to obtain a wave absorber shaped like a stick of gum with a shape which can be freely deformed by fingertip, For example, the wave absorber is significantly soft and deformable, as compared to the above-described wave absorber in which the silicone elastomer is used as the binder.

Further, in the above-described wave absorber which is made by using the silicone elastomer as the binder, the imaginary magnetic permeability μ" in the 1 GHz range is 10 or more. When the imaginary magnetic permeability μ" is 10 or more, the effect of electromagnetic suppression in the GHz band is improved, and the wave absorber can effectively absorb the unnecessary high frequency electric wave, and thus it is preferable.

Further, the silicone elastomer and the chlorinated polyethylene keep the shape of the wave absorber by binding the flat amorphous soft magnetic alloy powders of this embodiment, besides the function of increasing the impedance of the wave absorber. Further, the compression moldability of the silicone elastomer is excellent, and thus it is possible to constitute the high strength wave absorber, even though it is solidified and molded at room temperature. Further, the silicone elastomer and the chlorinated polyethylene have a sufficient elasticity inside the wave absorber. For example, even though an amorphous soft magnetic alloy powder showing a magnetostriction constant of $1\times10^{-6}$ to $50\times10^{-6}$ is used, the distortion thereof can be relieved and the internal stress of the wave absorber can be relieved to increase an imaginary magnetic permeability μ".

In the wave absorber of this embodiment, since the flat amorphous soft magnetic alloy powders of this embodiment are arranged in parallel to each other and in the form of a layer in the insulating material, it is possible to closely fill the amorphous soft magnetic alloy powders in the wave absorber, and shorten the gap between the powders. Further, the aspect ratio of the flat powder is large, the impedance the wave absorber itself is high, and the eddy current is suppressed as compared to the amorphous soft magnetic alloy powder having a substantially spherical shape. Specifically, when the aspect ratio of the flat amorphous soft magnetic alloy powder is 1 or more, the contact between the powders is reduced and the impedance of the wave absorber increases, and the generation of the eddy current is suppressed. Therefore, the imaginary magnetic permeability μ" of 6 or more is easily obtained in the GHz band. As a result, the effect of electromagnetic suppression of the wave absorber is improved.

When the aspect ratio of the flat amorphous soft magnetic alloy powder is 10 or more, the contact between the powder particles is more reduced. Therefore, the rate of increasing the impedance of the wave absorber is increased, and the generation of the eddy current is suppressed. Therefore, the imaginary magnetic permeability μ" of 10 or more is easily obtained in the GHz band. As a result, the effect of electromagnetic suppression of the wave absorber is improved.

An upper limit of the aspect ratio is preferably 800 or less. When the aspect ratio exceeds 800, it is difficult to disperse uniformly the powders and the surface of the obtained sheet is likely to be coarse and uneven. When the aspect ratio is 800 or less, it is possible to uniformly disperse and fill the powders. Further, the packing density thereof increases and the real part μ' the complex magnetic permeability increases. As a result, the imaginary part μ" of the complex magnetic permeability increases and the μ" value of 6 or more is easily obtained, and the effect of electromagnetic suppression is improved.

It is more preferable that the upper limit of the aspect ratio is 300 or less. When the aspect ratio is 300 or less, it is possible to uniformly disperse and fill the powders. Further, the packing density thereof increases and the real part μ' of the complex magnetic permeability increases. As a result, the imaginary part μ" of the complex magnetic permeability increases, the imaginary part μ" of 10 or more is easily obtained, and the effect of electromagnetic suppression is improved.

In the wave absorber of this embodiment, it is preferable that the content of the flat amorphous soft magnetic alloy powder is in a range of 30% by volume to 80% by volume. When the content of the flat amorphous soft magnetic alloy powder is 30% by volume or more, the amount of a magnetic substance is sufficient, and it is possible effectively show the effect of electromagnetic suppression. Further, when the content is 80% by volume or less, the impedance does not decrease due to the contact between alloy powders, and it is possible to ensure the high imaginary part μ", and thus it is possible to show effectively the effect of electromagnetic suppression.

The content of the silicone elastomer or the chlorinated polyethylene is that of the remaining part excluding the flat amorphous soft magnetic alloy powder.

According to the wave absorber of this embodiment, the flat amorphous soft magnetic alloy powder obtained by flattening the amorphous soft magnetic alloy powder which has a substantially spherical shape and shows excellent soft magnetic characteristics is used and it is possible to closely fill in the insulating material. Therefore, it is possible to improve the effect of electromagnetic suppression in the frequency band of several hundreds MHz to several GHz.

Further, the wave absorber according to this embodiment is obtained by mixing the flat amorphous soft magnetic alloy powder fabricated by flattening the amorphous soft magnetic alloy powder according to this embodiment, which has a substantially spherical shape and is produced by a water atomization method, and the insulating material, and thus the mass productivity is excellent.

Further, the above-described flat amorphous soft magnetic alloy powders may be coated with water glass. In the case that the flattened powder particles are coated with the water glass, the insulating property between powder particles further increases. Therefore, the impedance of the wave absorber is further improved. Further, it is possible to further increase the imaginary magnetic permeability μ" in the high frequency band and to further improve the effect of electromagnetic suppression.

EXAMPLES

Experimental Example 1

FeCrPCB-Based Alloy

Fe, a Fe—C alloy, a Fe—P alloy, B and Cr, Si, P, Nb, Mo, Ni, and Co were weighted in a predetermined amount as raw materials. These raw materials were weighted under an atmosphere of air so as to have a desired composition, and were melted in a high-frequency induction heating furnace under the reduced Ar atmosphere to thus make ingots with various compositions. These ingots were supplied to the molten metal crucible of a high-pressure water spraying device shown in FIG. 1 to melt them. Then, the resultant molten alloy was dropped from the molten metal nozzles of the molten metal crucible, and at the same time high-pressure water was sprayed from the water spraying nozzle of the water sprayer shown in FIG. 1 to turn the molten alloy into mist. Then, the mist of the molten alloy was quenched. Various soft magnetic alloy powders were produced by changing manufacturing conditions at the time of producing the soft magnetic alloy powder. Further, independently from these samples, a sample of a ribbon-shaped amorphous soft magnetic alloy was obtained by using ingots having various compositions and quenching molten alloys having compositions equivalent to those of the above-described samples by using a single roll method. Then, the magnetic characteristics of the amorphous soft magnetic alloy ribbon sample were measured.

Further, for the comparison, magnetic characteristics of amorphous soft magnetic alloy ribbon samples and amorphous soft magnetic alloy powder samples having compositions of $Fe_{81.5}P_{10.5}B_8$, $Fe_{80}P_{13}C_7$, $Fe_{78}Cr_2P_{13}C_7$, and $Fe_{73}Cr_2B_{15}Si_{10}$ were measured.

DSC (Differential Scanning Calorimetry) with respect to various soft magnetic alloy powers was performed. The glass transition temperature Tg, the crystallization initiation temperature Tx, the Curie temperature Tc, and the melting temperature Tm were measured. Further, the temperature interval ΔTx of the supercooled liquid and Tg/Tm were measured. Their results are shown in each Table. Further, the temperature rising rate at the time of performing the DSC was 0.67K/second. Further, Tm* in Tables represents a melting temperature of an alloy.

Further, the saturated magnetization σs of each of the obtained soft magnetic alloy powders was measured by using a vibration sample magnetometer (VSM).

The results of compositions and magnetic characteristics of the amorphous soft magnetic alloy ribbon samples and the amorphous soft magnetic alloy powder samples are shown in Tables 1 to 6. Further, the symbol ↓ is used to mean that each column having the symbol ↓ has the same value as that described at the column above the column having the symbol ↓.

TABLE 1

| | | Ribbon | | | | | | | | | | |
|---|---|---|---|---|---|---|---|---|---|---|---|---|
| | composition | structure | Tc/K | Tg/K | Tx/K | ΔTx/K | Tm* | Tg/Tm | Tx/Tm | σs × $10^{-6}$ Wbm/kg | Hc/$Am^{-1}$ | Hv |
| 1 | $Fe_{81.5}P_{10.5}C_8$ | amorphous | 582 | 681 | 705 | 24 | 1301 | 0.54 | 0.54 | 214 | 9.2 | 842 |
| 2 | $Fe_{80}P_{13}C_7$ | " | 581 | 696 | 734 | 38 | 1467 | 0.47 | 0.5 | 199 | 2.6 | 839 |
| 3 | $Fe_{78}Cr_2P_{13}C_7$ | " | 543 | 707 | 746 | 39 | 1463 | 0.48 | 0.51 | 177 | 2.0 | 891 |
| 4 | $Fe_{73}Cr_2B_{15}Si_{10}$ | " | 651 | — | 830 | — | 1486 | — | 0.56 | 200 | 3.0 | 1050 |
| 5 | $Fe_{72}Ai_3P_{9.55}C_{5.75}B_{4.6}Si_5$ | amorphous | 547 | 765 | 831 | 66 | 1325 | 0.58 | 0.63 | 165 | 2.8 | 1090 |
| 6 | $Fe_{78}P_{7.31}C_{4.84}B_{8.35}Si_{1.5}$ | " | 640 | 758 | 791 | 33 | 1309 | 0.579 | 0.604 | 207 | 2.5 | 905 |
| 7 | $Fe_{79}P_{5.1}C_{4.2}B_{9.7}Si_{2.0}$ | " | 640 | 764 | 799 | 35 | 1375 | 0.556 | 0.581 | 212 | 2.3 | 920 |
| 8 | $Fe_{77.9}P_{7.3}C_{2.2}B_{7.7}Si_{4.9}$ | " | 543 | 741 | 787 | 46 | 1318 | 0.562 | 0.597 | 199 | 3.2 | 929 |
| 9 | $Fe_{77.4}P_{7.3}C_{2.2}B_{7.7}Si_{5.4}$ | " | 647 | 752 | 796 | 44 | 1355 | 0.555 | 0.587 | 207 | 3.2 | 945 |
| 10 | " | " | " | " | " | " | " | " | " | " | " | " |
| 11 | $Fe_{77.9}P_{7.3}C_{2.2}B_{8.2}Si_{4.4}$ | " | 644 | 744 | 790 | 46 | 1331 | 0.559 | 0.594 | 204 | 2.4 | 940 |
| 12 | $Fe_{77.9}P_{7.3}C_{2.2}B_{7.7}Si_{4.4}$ | " | 644 | 741 | 786 | 45 | 1322 | 0.561 | 0.595 | 205 | 3.6 | 932 |
| 14 | $Fe_{77.9}Cr_{0.5}P_{9.3}C_{2.2}B_{5.7}Si_{4.4}$ | " | 612 | 737 | 777 | 40 | 1297 | 0.568 | 0.599 | 195 | 2.8 | 919 |
| 15 | $Fe_{77.9}Cr_{0.5}P_{8.8}C_{2.2}B_{6.2}Si_{4.4}$ | " | 621 | 737 | 778 | 41 | 1307 | 0.564 | 0.595 | 205 | 2.8 | 933 |
| 16 | $Fe_{77.9}Cr_{0.5}P_{7.3}C_{2.2}B_{7.7}Si_{4.4}$ | " | 627 | 737 | 782 | 45 | 1326 | 0.556 | 0.590 | 204 | 2.4 | 940 |
| 18 | $Fe_{77.4}Cr_1P_{8.3}C_{2.2}B_{6.7}Si_{4.4}$ | " | 610.4 | 738 | 781 | 43 | 1311 | 0.563 | 0.596 | 199 | 2.8 | 908 |
| 19 | $Fe_{76.9}Cr_1P_{8.3}C_{2.2}B_{7.2}Si_{4.4}$ | " | 612 | 746 | 795 | 49 | 1329 | 0.561 | 0.598 | 197 | 4.0 | 910 |
| 20 | $Fe_{77.4}Cr_1P_{7.3}C_{2.2}B_{7.7}Si_{4.4}$ | " | 617 | 735 | 789 | 54 | 1332 | 0.552 | 0.592 | 204 | 2.8 | 915 |
| 21 | $Fe_{76.9}Cr_1P_{7.3}C_{2.2}B_{6.2}Si_{4.4}$ | " | 617 | 745 | 795 | 50 | 1372 | 0.543 | 0.579 | 209 | 2.0 | 920 |

TABLE 1-continued

| | composition | Ribbon structure | Tc/K | Tg/K | Tx/K | ΔTx/K | Tm* | Tg/Tm | Tx/Tm | σs × $10^{-6}$ Wbm/kg | Hc/$Am^{-1}$ | Hv |
|---|---|---|---|---|---|---|---|---|---|---|---|---|
| 22 | $Fe_{77.4}Cr_1P_{7.8}C_{2.2}B_{6.2}Si_{5.4}$ | " | 611 | 734 | 778 | 44 | 1302 | 0.564 | 0.598 | 208 | 3.2 | 903 |
| 23 | $Fe_{77.4}Cr_1P_{6.8}C_{2.2}B_{7.2}Si_{5.4}$ | " | 615 | 712 | 776 | 64 | 1318 | 0.540 | 0.589 | 198 | 3.2 | 917 |
| 24 | $Fe_{77.4}Cr_1P_{6.8}C_{2.2}B_{8.2}Si_{4.4}$ | " | 617 | 724 | 784 | 60 | 1333 | 0.543 | 0.588 | 206 | 2.8 | 925 |
| 25 | $Fe_{77.4}Cr_1P_{7.8}C_{2.2}B_{8.2}Si_{3.4}$ | " | 615 | 742 | 785 | 43 | 1340 | 0.554 | 0.586 | 204 | 2.4 | 922 |
| 26 | $Fe_{77.4}Cr_1P_{8.3}C_{3.2}B_{5.7}Si_{4.4}$ | " | 606 | 729 | 774 | 45 | 1291 | 0.565 | 0.600 | 183 | 2.6 | 901 |
| 27 | $Fe_{75.4}Cr_3P_{10.8}C_{2.2}B_{4.2}Si_{4.4}$ | amorphous | 545 | 744 | 779 | 35 | 1309 | 0.568 | 0.595 | 180 | 1.6 | 930 |
| 28 | $Fe_{72.39}Cr_4P_{9.04}C_{2.16}B_{7.54}Si_{4.87}$ | " | 540 | 785 | 841 | 56 | 1301 | 0.6 | 0.65 | 155 | 2.0 | 939 |
| 29 | $Fe_{76.4}Cr_2P_{10.8}C_{2.2}B_{3.2}Si_{5.4}$ | " | 569 | 741 | 774 | 33 | 1296 | 0.572 | 0.597 | 188 | 1.9 | 920 |

TABLE 2

| | Powder Shape | $D_{50}$ (μm) | Tap density (Mg/$m^3$) | Specific surface area ($m^2$/g) | oxygen (ppm) | Aspect ratio Min. | Aspect ratio Max. | Aspect ratio Average | Structure | Core Core loss (kw/$m^3$) | Magnetic permeability μ' | DC superimposing μ' Dc5500 | remark | Si/P + Si |
|---|---|---|---|---|---|---|---|---|---|---|---|---|---|---|
| 1 | Substantially spherical shape | 9.67 | 4.05 | 0.37 | 0.22 | 1.0 | 5.7 | 1.2 | Amorphous + crystalline | 2200 | 50.0 | 34.0 | The converted glassification temperature is low | |
| 2 | Substantially spherical shape | 9.85 | 4.00 | 0.36 | 0.21 | | 5.3 | 1.2 | Amorphous + crystalline | 1500 | 55.0 | 33.0 | | |
| 3 | Substantially spherical shape | 9.73 | 3.98 | 0.37 | 0.21 | | 4.9 | 1.2 | Amorphous + crystalline | 1200 | 56.0 | 32.0 | | |
| 4 | Substantially spherical shape | 8.51 | 4.13 | 0.30 | 0.13 | | 5.7 | 1.2 | Amorphous + crystalline | 1500 | 58.0 | 33.0 | | |
| 5 | Substantially spherical shape | 9.50 | 3.95 | 0.35 | 0.20 | 1.0 | 4.4 | 1.3 | Amorphous | 390 | 62.0 | 32.0 | High hardness, a number of semimetals | 0.341 |
| 6 | Substantially spherical shape | 14.5 | 4.15 | 0.39 | 0.34 | 1.0 | 8.5 | 1.6 | Amorphous | 380 | 69.5 | 33.0 | Amount of Si is small, oxygen increases | 0.17 |
| 7 | Substantially spherical shape | 15.1 | 4.21 | 0.21 | 0.27 | 1.0 | 7.6 | 1.5 | Amorphous | 360 | 72.5 | 35.5 | Amount of Si is small, oxygen increases | 0.282 |
| 8 | | | | | | | | | | | | | | 0.402 |
| 9 | Substantially spherical shape | 15.90 | 4.11 | 0.28 | 0.20 | 1.0 | 9.0 | 1.5 | Amorphous | 323 | 72.7 | 37.5 | | 0.425 |
| 10 | Substantially spherical shape | 12.38 | 4.03 | 0.24 | 0.19 | 1.0 | 5.0 | 1.2 | " | 306 | 61.8 | 36.8 | | 0.425 |
| 11 | | | | | | | | | | | | | | 0.376 |
| 12 | Substantially spherical shape | 16.01 | 4.35 | 0.27 | 0.16 | 1.0 | 6.5 | 1.3 | Amorphous | 336 | 69.1 | 36.3 | | 0.376 |
| 14 | | | | | | | | | | | | | | 0.321 |
| 15 | Substantially spherical shape | 15.61 | 4.15 | 0.30 | 0.19 | 1.0 | 5.8 | 1.4 | Amorphous | 361 | 70.5 | 36.8 | | 0.333 |

TABLE 2-continued

| | Powder | | | | | | | | Core | | | | |
|---|---|---|---|---|---|---|---|---|---|---|---|---|---|
| | Shape | $D_{50}$ (μm) | Tap density (Mg/m$^3$) | Specific surface area (m$^2$/g) | oxygen (ppm) | Aspect ratio Min. | Aspect ratio Max. | Aspect ratio Average | Structure | Core loss (kw/m$^3$) | Magnetic permeability μ' | DC superimposing μ' Dc5500 | remark | Si/P + Si |
| 16 | | | | | | | | | | | | | | 0.376 |
| 18 | Substantially spherical shape | 15.63 | 4.28 | 0.19 | 0.12 | 1.0 | 8.7 | 1.4 | Amorphous | 363 | 80.8 | 37.4 | | 0.346 |
| 19 | | | | | | | | | | | | | | 0.346 |
| 20 | Substantially spherical shape | 15.89 | 4.19 | 0.19 | 0.15 | 1.0 | 8.6 | 1.4 | Amorphous | 366 | 81.9 | 38.3 | | 0.376 |
| 21 | | | | | | | | | | | | | | 0.376 |
| 22 | Substantially spherical shape | 16.01 | 4.15 | 0.18 | 0.12 | 1.0 | 6.3 | 1.4 | Amorphous | 360 | 84.0 | 40.0 | | 0.409 |
| 23 | | | | | | | | | | | | | | 0.442 |
| 24 | | | | | | | | | | | | | | 0.393 |
| 25 | | | | | | | | | | | | | | 0.304 |
| 26 | | | | | | | | | | | | | | 0.346 |
| 27 | Substantially spherical shape | 15.36 | 4.20 | 0.19 | 0.11 | 1.0 | 7.6 | 1.6 | Amorphous | 335 | 89.5 | 35.0 | | 0.289 |
| 28 | Substantially spherical shape | 15.62 | 4.26 | 0.19 | 0.11 | 1.0 | 6.2 | 1.5 | " | 322 | 90.2 | 32.1 | Saturated magnetism decreases | 0.35 |
| 29 | Substantially spherical shape | 14.92 | 4.20 | 0.19 | 0.11 | 1.0 | 4.5 | 1.5 | " | 310 | 87.0 | 37.3 | | 0.333 |

TABLE 3

| | | Ribbon | | | | | | | | | | |
|---|---|---|---|---|---|---|---|---|---|---|---|---|
| | Composition | Structure | Tc/K | Tg/K | Tx/K | ΔTx/K | Tm | Tg/Tm | Tx/Tm | σs × $10^{-6}$ Wbm/kg | Hc/Am$^{-1}$ | Hv |
| 30 | $Fe_{76.4}Cr_2P_{10.8}C_{2.2}B_{4.2}Si_{4.4}$ | Amorphous | 567 | 745 | 776 | 31 | 1308 | 0.570 | 0.593 | 182 | 2.1 | 905 |
| 31 | " | " | " | " | " | " | " | " | " | " | " | " |
| 32 | " | " | " | " | " | " | " | " | " | " | " | " |
| 33 | " | " | " | " | " | " | " | " | " | " | " | " |
| 34 | " | " | " | " | " | " | " | " | " | " | " | " |
| 35 | " | " | " | " | " | " | " | " | " | " | " | " |
| 36 | $Fe_{76.9}Cr_2P_{10.8}C_{2.2}B_{4.2}Si_{3.9}$ | Amorphous | 568 | 739 | 769 | 30 | 1305 | 0.566 | 0.589 | 188 | 2.4 | 895 |
| 37 | $Fe_{75.9}Cr_2P_{10.8}C_{2.2}B_{4.2}Si_{4.9}$ | " | 573 | 752 | 785 | 33 | 1314 | 0.572 | 0.597 | 186 | 2.1 | 920 |
| 38 | $Fe_{76.4}Cr_2P_{10.8}C_{2.2}B_{5.2}Si_{3.4}$ | " | 568 | 744 | 779 | 35 | 1321 | 0.563 | 0.590 | 189 | 2.2 | 943 |
| 39 | $Fe_{76.4}Cr_2P_{10.8}C_{3.2}B_{4.2}Si_{3.4}$ | " | 570 | 739 | 774 | 35 | 1309 | 0.564 | 0.591 | 189 | 2.8 | 903 |
| 40 | $Fe_{76.4}Cr_2P_{9.8}C_{2.2}B_{5.2}Si_{4.4}$ | " | 576 | 746 | 780 | 34 | 1301 | 0.573 | 0.600 | 193 | 1.8 | 910 |
| 41 | $Fe_{76.4}Cr_2P_{9.8}C_{3.2}B_{5.2}Si_{3.4}$ | " | 571 | 743 | 779 | 36 | 1303 | 0.570 | 0.598 | 193 | 2.8 | 908 |
| 42 | $Fe_{76.9}Cr_2P_{9.8}C_{2.2}B_{5.2}Si_{3.9}$ | " | 572 | 738 | 773 | 35 | 1303 | 0.566 | 0.593 | 188 | 4.0 | 890 |
| 43 | $Fe_{76.4}Cr_2P_{9.3}C_{2.2}B_{5.7}Si_{4.4}$ | " | 576 | 749 | 784 | 35 | 1311 | 0.571 | 0.598 | 196 | 1.6 | 910 |
| 44 | $Fe_{76.4}Cr_2P_{8.8}C_{2.2}B_{5.2}Si_{5.4}$ | " | 581 | 733 | 779 | 46 | 1299 | 0.564 | 0.600 | 185 | 2.1 | 912 |
| 45 | $Fe_{76.4}Cr_2P_{7.8}C_{2.2}B_{6.2}Si_{5.4}$ | " | 586 | 733 | 780 | 47 | 1309 | 0.560 | 0.596 | 193 | 1.6 | 920 |
| 46 | $Fe_{76.4}Cr_2P_{7.8}C_{2.2}B_{7.2}Si_{4.4}$ | " | 589 | 739 | 786 | 47 | 1327 | 0.557 | 0.592 | 193 | 1.7 | 911 |
| 47 | $Fe_{76.4}Cr_2P_{8.8}C_{2.2}B_{6.2}Si_{4.4}$ | " | 589 | 738 | 788 | 50 | 1336 | 0.552 | 0.590 | 193 | 2.4 | 914 |
| 50 | $Fe_{78.4}Mo_{0.5}P_{10.3}C_{2.2}B_{4.7}Si_{3.9}$ | Amorphous | 600 | 728 | 767 | 39 | 1292 | 0.563 | 0.594 | 207 | 2.5 | 875 |
| 51 | $Fe_{78.4}Mo_{0.5}P_{8.3}C_{2.2}B_{5.7}Si_{4.9}$ | " | 610 | 727 | 770 | 43 | 1320 | 0.551 | 0.583 | 208 | 2.9 | 890 |
| 53 | $Fe_{78.4}Mo_{0.5}P_{8.3}C_{2.2}B_{6.7}Si_{3.9}$ | " | 611 | 730 | 774 | 44 | 1325 | 0.551 | 0.584 | 209 | 2.2 | 887 |
| 54 | $Fe_{78.4}Mo_{0.5}P_{6.8}C_{2.2}B_{8.2}Si_{3.5}$ | " | 620 | 722 | 778 | 56 | 1326 | 0.544 | 0.587 | 213 | 2.5 | 899 |
| 57 | $Fe_{78.4}Mo_{0.5}P_{7.3}C_{2.2}B_{7.7}Si_{3.9}$ | " | 619 | 736 | 777 | 41 | 1318 | 0.558 | 0.590 | 217 | 2.6 | 905 |

TABLE 4

| | Powder | | | | | | | | | core | | | | |
|---|---|---|---|---|---|---|---|---|---|---|---|---|---|---|
| | Shape | $D_{50}$ (μm) | Tap density (Mg/m$^3$) | Specific surface area (m$^2$/g) | Oxygen (ppm) | Aspect ratio Min. | Aspect ratio Max. | Aspect ratio average | Structure | Core loss (kw/m$^3$) | Magnetic perme-ability μ' | DC super-imposing μ' Dc5500 | Remark | Si/ P + Si |
| 30 | Amorphous | 60.70 | 3.20 | 0.59 | 0.45 | 1.0 | 17.0 | 4.5 | Amorphous | 1600 | 165.0 | 33.0 | | 0.289 |
| 31 | Substantially spherical shape | 18.31 | 4.28 | 0.17 | 0.11 | " | 9.0 | 2.3 | " | 380 | 100.0 | 37.0 | | 0.289 |
| 32 | Substantially spherical shape | 16.26 | 4.09 | 0.17 | 0.10 | " | 8.5 | 1.9 | " | 364 | 91.0 | 37.0 | | 0.289 |
| 33 | Substantially spherical shape | 16.02 | 4.26 | 0.19 | 0.11 | " | 7.3 | 1.8 | " | 344 | 89.0 | 37.1 | | 0.289 |
| 34 | Substantially spherical shape | 11.92 | 3.99 | 0.20 | 0.12 | " | 6.0 | 1.4 | " | 276 | 84.0 | 37.1 | | 0.289 |
| 35 | Substantially spherical shape | 9.08 | 4.06 | 0.21 | 0.12 | " | 4.5 | 1.3 | " | 250 | 76.0 | 36.8 | | 0.289 |
| 36 | Substantially spherical shape | 15.62 | 4.26 | 0.19 | 0.11 | 1.0 | 7.3 | 1.6 | Amorphous | 366 | 84.3 | 37.3 | | 0.265 |
| 37 | | | | | | | | | | | | | | 0.312 |
| 38 | | | | | | | | | | | | | | 0.239 |
| 39 | | | | | | | | | | | | | | 0.239 |
| 40 | | | | | | | | | | | | | | 0.31 |
| 41 | | | | | | | | | | | | | | 0.258 |
| 42 | | | | | | | | | | | | | | 0.285 |
| 43 | Substantially spherical shape | 15.93 | 4.22 | 0.17 | 0.11 | 1.0 | 7.5 | 1.6 | Amorphous | 351 | 83.1 | 37.2 | | 0.321 |
| 44 | | | | | | | | | | | | | | 0.38 |
| 45 | | | | | | | | | | | | | | 0.409 |
| 46 | | | | | | | | | | | | | | 0.361 |
| 47 | | | | | | | | | | | | | | 0.393 |
| 50 | | | | | | | | | | | | | | 0.275 |
| 51 | | | | | | | | | | | | | | 0.371 |
| 53 | | | | | | | | | | | | | | 0.32 |
| 54 | | | | | | | | | | | | | | 0.364 |
| 57 | Substantially spherical shape | 15.42 | 4.28 | 0.35 | 0.21 | 1.0 | 5.5 | 1.4 | Amorphous | 371 | 65.6 | 38.7 | | 0.348 |

TABLE 5

| | | Ribbon | | | | | | | | | | |
|---|---|---|---|---|---|---|---|---|---|---|---|---|
| | Composition | Structure | Tc/K | Tg/K | Tx/K | ΔTx/K | Tm* | Tg/Tm | Tx/Tm | σs ($10^{-6}$ Wbm/kg | Hc/Am$^{-1}$ | Hv |
| 59 | $Fe_{76.9}Mo_2P_{10.3}C_{2.2}B_{5.2}Si_{3.4}$ | Amorphous | 557 | 743 | 774 | 31 | 1298 | 0.572 | 0.596 | 188 | 2.8 | 913 |
| 60 | $Fe_{77.4}Mo_2P_{9.8}C_{2.2}B_{5.2}Si_{3.4}$ | " | 553 | 739 | 771 | 32 | 1287 | 0.574 | 0.5999 | 185 | 2.8 | 905 |
| 61 | $Fe_{77.4}Mo_2P_{9.8}C_{2.2}B_{4.2}Si_{4.4}$ | " | 554 | 727 | 767 | 40 | 1315 | 0.553 | 0.583 | 188 | 2.8 | 895 |
| 62 | $Fe_{77.4}Mo_2P_{9.3}C_{2.2}B_{5.7}Si_{3.4}$ | " | 557 | 737 | 771 | 34 | 1290 | 0.571 | 0.598 | 189 | 2.2 | 908 |
| 64 | $Fe_{74.43}Mo_{1.96}P_{9.04}C_{2.16}B_{7.54}Si_{4.87}$ | " | 589 | 777 | 835 | 58 | 1321 | 0.588 | 0.632 | 180 | 3.6 | 985 |
| 65 | $Fe_{78.4}Nb_{0.5}P_{7.3}C_{2.2}B_{7.7}Si_{3.9}$ | Amorphous | 621 | 734 | 780 | 46 | 1321 | 0.556 | 0.590 | 219 | 3.2 | 890 |
| 66 | $Fe_{74.43}Nb_{1.96}P_{9.04}C_{2.16}B_{7.54}Si_{4.87}$ | " | 584 | 791 | 843 | 52 | 1325 | 0.597 | 0.613 | 180 | 4.4 | 995 |
| 68 | $Fe_{76}Zr_2P_{9.23}C_{2.2}B_{7.7}Si_{2.87}$ | " | 594 | 755 | 789 | 34 | 1359 | 0.556 | 0.591 | 192 | 3.2 | 935 |
| 71 | $Fe_{77}Al_2P_{8.81}C_{2.1}B_{7.35}Si_{2.74}$ | " | 640 | 768 | 807 | 39 | 1306 | 0.59 | 0.62 | 207 | 2.0 | 905 |
| 72 | $Fe_{77}Al_1P_{9.23}C_{2.2}B_{7.7}Si_{2.87}$ | " | 640 | 774 | 811 | 37 | 1370 | 0.56 | 0.59 | 206 | 1.8 | 920 |
| 73 | $Fe_{71.39}Ni_5P_{9.04}C_{2.16}B_{7.54}Si_{4.87}$ | Amorphous | 595 | 778 | 814 | 36 | 1361 | 0.572 | 0.632 | 190 | 2.8 | 979 |
| 76 | $Fe_{72.9}Ni_5P_{10.3}C_{2.2}B_{5.7}Si_{3.9}$ | " | 629 | 741 | 778 | 39 | 1298 | 0.571 | 0.599 | 201 | 4.0 | 912 |
| 77 | $Fe_{71.4}Ni_5P_{7.8}C_{2.2}B_{7.2}Si_{4.4}$ | " | 596 | 734 | 780 | 46 | 1315 | 0.558 | 0.593 | 180 | 4.0 | 905 |
| 79 | $Fe_{71.4}Co_5Cr_2P_{7.8}C_{2.2}B_{7.2}Si_{4.4}$ | Amorphous | 617 | 736 | 780 | 44 | 1317 | 0.559 | 0.592 | 194 | 3.8 | 910 |
| 80 | $Fe_{58.4}Co_{20}Cr_2P_{7.8}C_{2.2}B_{7.2}Si_{4.4}$ | " | 689 | 740 | 780 | 40 | 1286 | 0.575 | 0.607 | 185 | 5.5 | 895 |
| | $Fe_{58.4}Co_{20}P_{7.8}C_{2.2}B_{7.2}Si_{4.4}$ | " | 730 | 750 | 790 | 40 | 1290 | 0.581 | 0.605 | 208 | 6.1 | 880 |

TABLE 6

| | Powder | | | | | | | | | | | | | |
|---|---|---|---|---|---|---|---|---|---|---|---|---|---|---|
| | shape | D50 (μm) | Tap density (Mg/m$^3$) | Specific surface area (m$^2$/g) | oxygen (ppm) | Aspect ratio Min. | Aspect ratio Max. | Aspect ratio average | structure | Core loss (kw/m$^3$) | magnetic perme-ability μ' | Direct current overlay ((DC5500 | remark | Si P + Si |
| 59 | | | | | | | | | | | | | | 0.248 |
| 60 | | | | | | | | | | | | | | 0.258 |
| 61 | | | | | | | | | | | | | | 0.31 |
| 62 | Substantially spherical shape | 15.07 | 4.27 | 0.23 | 0.15 | 1.0 | 6.3 | 1.5 | amorphous | 348 | 79.6 | 37.1 | | 0.258 |
| 64 | | | | | | | | | | | | | | 0.35 |
| 65 | | | | | | | | | | | | | | 0.348 |
| 66 | | | | | | | | | | | | | | 0.35 |
| 68 | Substantially spherical shape | 16.5 | 4.3 | 0.27 | 0.2 | 1.0 | 7.4 | 1.5 | Amorphous | 370 | 79.0 | 37.5 | | 0.237 |
| 71 | Substantially spherical shape | 15.21 | 4.21 | 0.28 | 0.2 | 1.0 | 8.9 | 1.6 | Amorphous | 390 | 78.5 | 37.0 | | 0.237 |
| 72 | | | | | | | | | | | | | | 0.237 |
| 73 | | | | | | | | | | | | | | 0.35 |
| 76 | Substantially spherical shape | 14.70 | 4.26 | 0.23 | 0.14 | 1.0 | 4.9 | 1.4 | Amorphous | 294 | 74.3 | 36.9 | | 0.275 |
| 77 | | | | | | | | | | | | | | 0.361 |
| 79 | | | | | | | | | | | | | | 0.361 |
| 80 | Substantially spherical shape | 15.23 | 4.35 | 0.26 | 0.16 | 1.0 | 7.8 | 1.5 | Amorphous | 370 | 75.0 | 37.5 | | 0.361 |
| | | | | | | | | | | | | | | 0.361 |

In Tables 1–6, samples 1 to 6 correspond to comparative examples. The converted glassification temperature of samples 1 to 3 was low. When the samples were powdered, they showed a partially crystallized structure. The sample 4 was hardened since the amount of a semimetal+Si was large, and the hardness Hv of thereof exceeded 1000. Sample 5 was hardened since the amount of a semimetal+Si was large, and the hardness Hv of thereof exceeded 1000. Further, the core loss of any samples 1 to 4 exceeded 1000 kW/m$^3$. In a sample 6, the amount of Si was small, the oxygen concentration increased, and the DC superimposing characteristic μ (DC=5500 A/m) was less than 35.

In a sample 28 in which Cr (element M) of 4 atomic % (exceeds 3 atomic % defined in the invention) is contained, the saturated magnetization σs was decreased to $155\times10^{-6}$ Wbm/kg. In a sample 30 which is a large one having D50 of 60.7 μm, but the core loss thereof was significantly increased to 1600 kW/m$^3$.

In other samples, as shown from the results of Tables 1–6, when a sample is made by using an amorphous soft magnetic alloy powder having an alloy composition showing magnetic characteristics, that is, $180\times10^{-6}$ Wbm/kg≦saturated magnetization σs≦$217\times10^{-6}$ Wbm/kg, and 1.6 A/m≦coercive force Hc≦6.1 A/m, in which 9.08≦D50≦18.31 μm, 3.99 Mg/m$^3$≦tap density≦4.35 Mg/m$^3$, 0.35 m$^2$/g≦specific surface area≦0.17 m$^2$/g, and the oxygen concentration was 0.21 ppm or less, the value W was 390 kW/m$^3$ or less, at 100 kHz, 0.1 T. Further, the sample shown a constant magnetic permeability μ' of 61.8 to 100 and μ (DC=5500 A/m) of 35 to 40 at 1 MHz or less.

Samples 73 to 77 are samples of a composition system in which a part of Fe is substituted with Ni, and samples 79 and 80 are samples in which a part of Fe is substituted with Co. In a composition system to which Ni was added, an amorphous soft magnetic alloy powder having excellent corrosion resistance was obtained, even though Cr was not contained thereto. Further, in a composition system to which Co is added, Tc is increased, and thus the temperature used can be increased.

In a relational expression, that is, 0.28<{Si/(P+Si)}<0.45, when the value of {Si/(P+Si)} is less than 0.28, ΔTx is relatively low as a degree of 30 to 40. Further, the value of {Si/(P+Si)} exceeds 0.45, Tg/tm becomes 0.54 or less.

Figure 5:
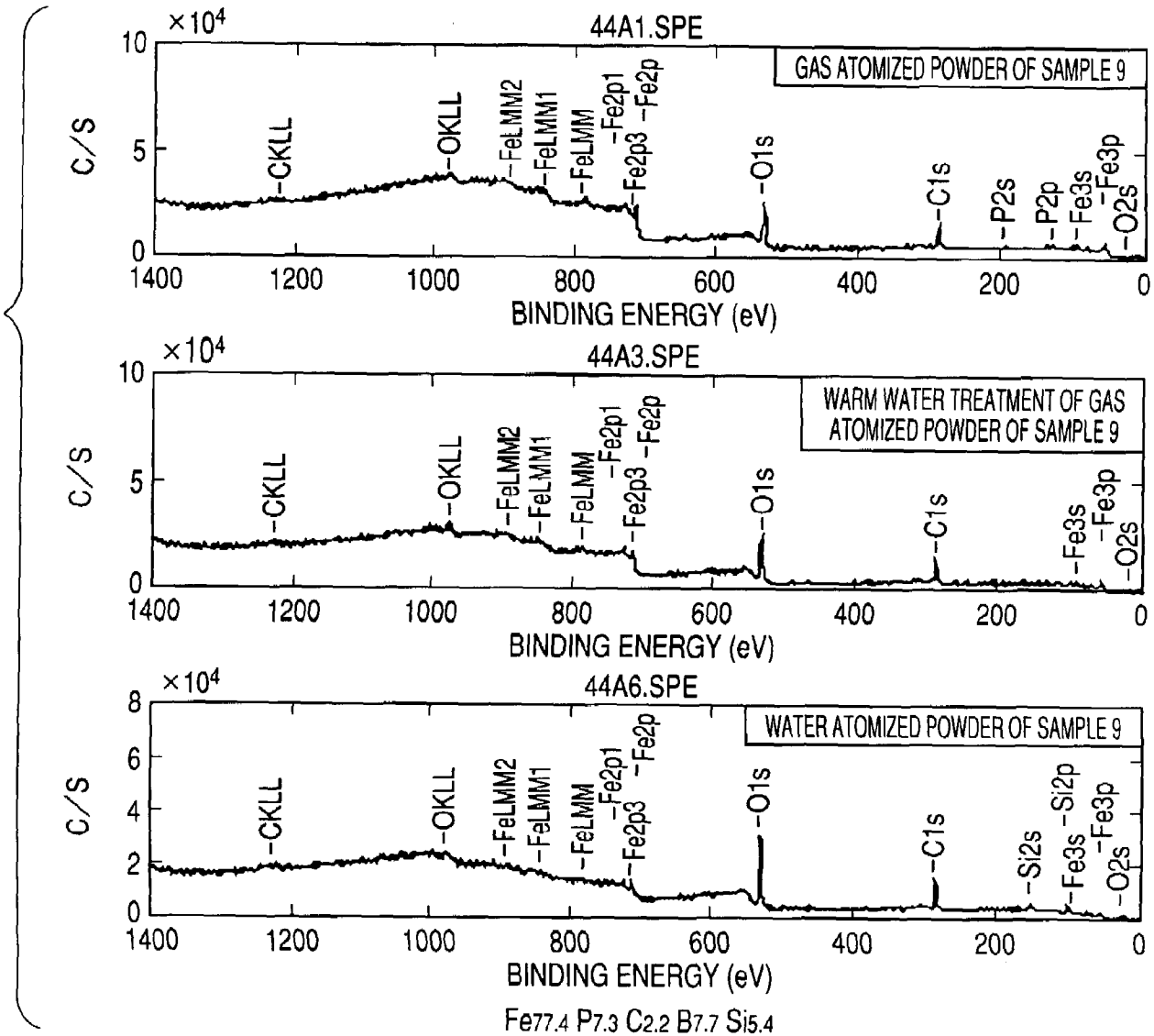
FIG. 5 is a view showing results from wide band spectrum analysis using an XPS, with respect to each outermost surface of a sample which is produced by a gas atomization method, a sample which is produced by a gas atomization method and is treated by warm water, and a sample which is produced by a water atomization method, in an amorphous soft magnetic alloy powder with a composition ratio of $Fe_{77.4}P_{7.3}C_{2.2}B_{7.7}Si_{5.4}$.

FIG. 5 shows results from wide band spectrum analysis using an XPS (X-ray photoelectron spectroscopy), with respect to each outermost surface of a sample which is produced by a gas atomization method, a sample which is produced by a gas atomization method and is treated by warm water, and a sample which is produced by a water atomization method, in an amorphous soft magnetic alloy powder with a composition ratio of $Fe_{77.4}P_{7.3}C_{2.2}B_{7.7}Si_{5.4}$ as a sample 9. The manufacturing condition in the gas atomization method is as follows: A tapping temperature is 1400° C., A diameter of nozzle is 1 mmφ, a kind of gas is Ar, and a gas pressure is 10 MPa. A sample which is treated with warm water under the gas atomization method means a sample which is made under a condition in which powders is dipped into pure water of 50° C. with stirring for 30 minutes (at a state close to a circumstance until the powders are recovered after water atomization).

From results shown in FIG. 5, in the amorphous soft magnetic alloy powder sample manufactured by the water atomization method, the amount of oxygen at the surface thereof is clearly increased, and Si is detected only at the surface portion of the amorphous soft magnetic alloy powder sample manufactured by the water atomization method. In any one of the amorphous soft magnetic alloy powders, the peaks of elements Fe, Cr, B, Si, etc. are shifted toward an energy higher than those which are generally observed in elemental metals. Therefore, it is assumed that an oxide or hydride is generated. The peak of the sample manufactured by the water atomization method is largely shifted toward the highest energy side, and the amount of oxygen at the surface thereof is larger than that of other samples. It is considered that Fe is further corroded. However, it is assumed that Si exists at the surface portion, and thus Si forms a passive film and the passive film prevents the characteristics thereof from being deteriorated.

Figure 6:
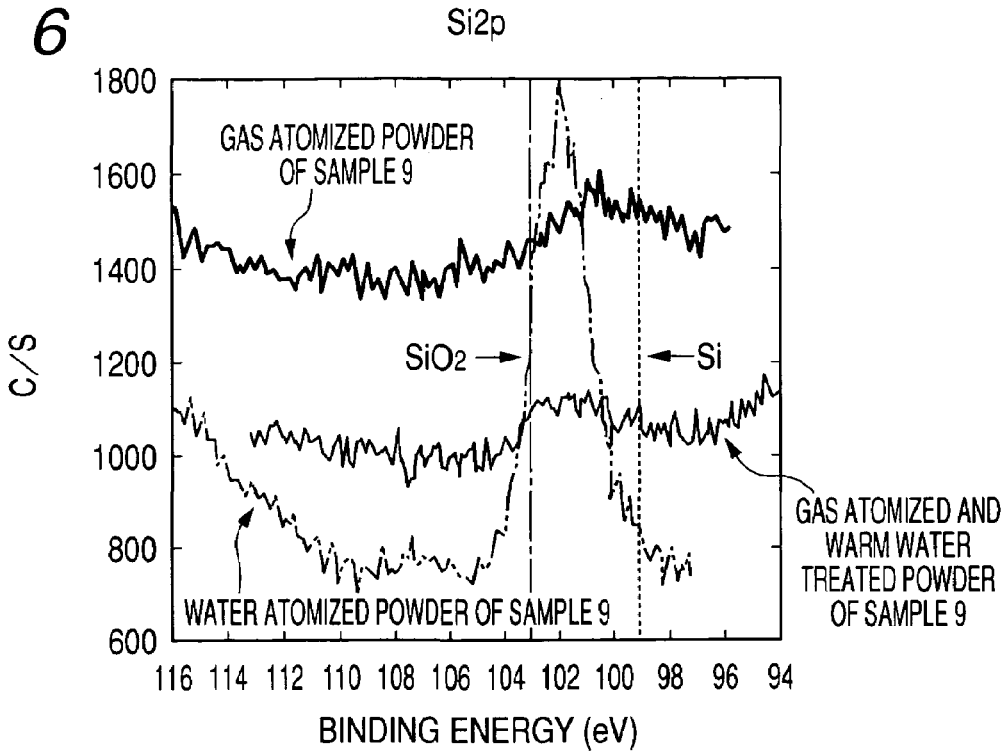
FIG. 6 is a view showing results from narrow band spectrum analysis observed for Si and $SiO_2$ using the same XPS, with respect to a sample 9 shown in Table 1.
Figure 7:
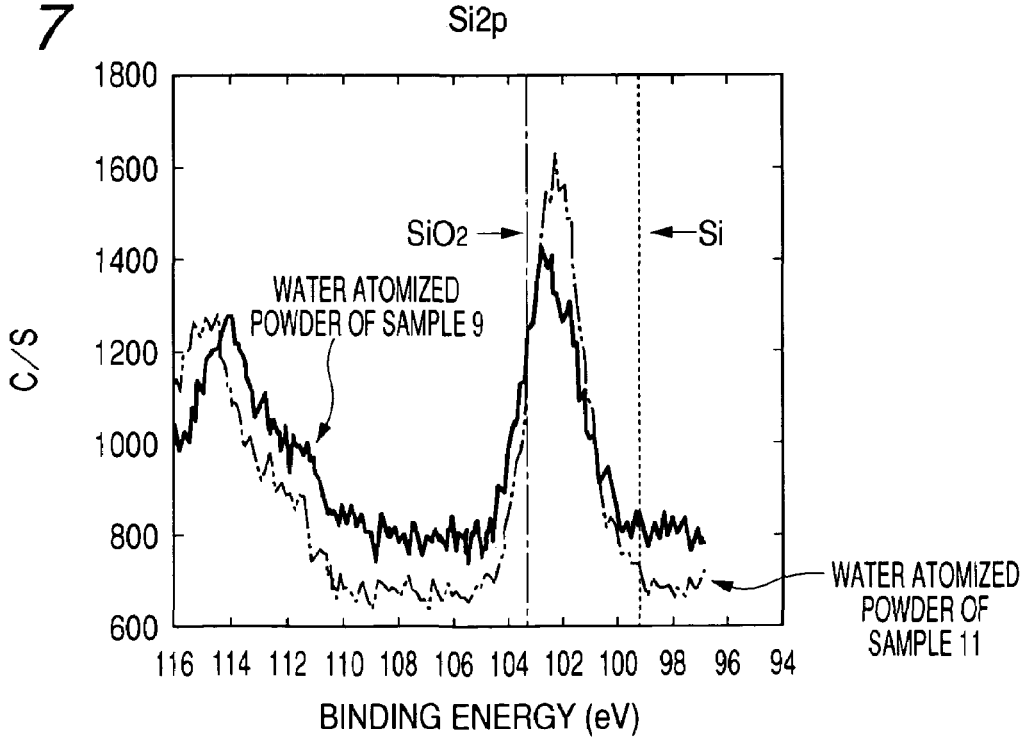
FIG. 7 is a view showing results from narrow band spectrum analysis observed for Si and $SiO_2$ using the same XPS, with respect to samples 9 and 11 shown in Table 1.
Figure 8:
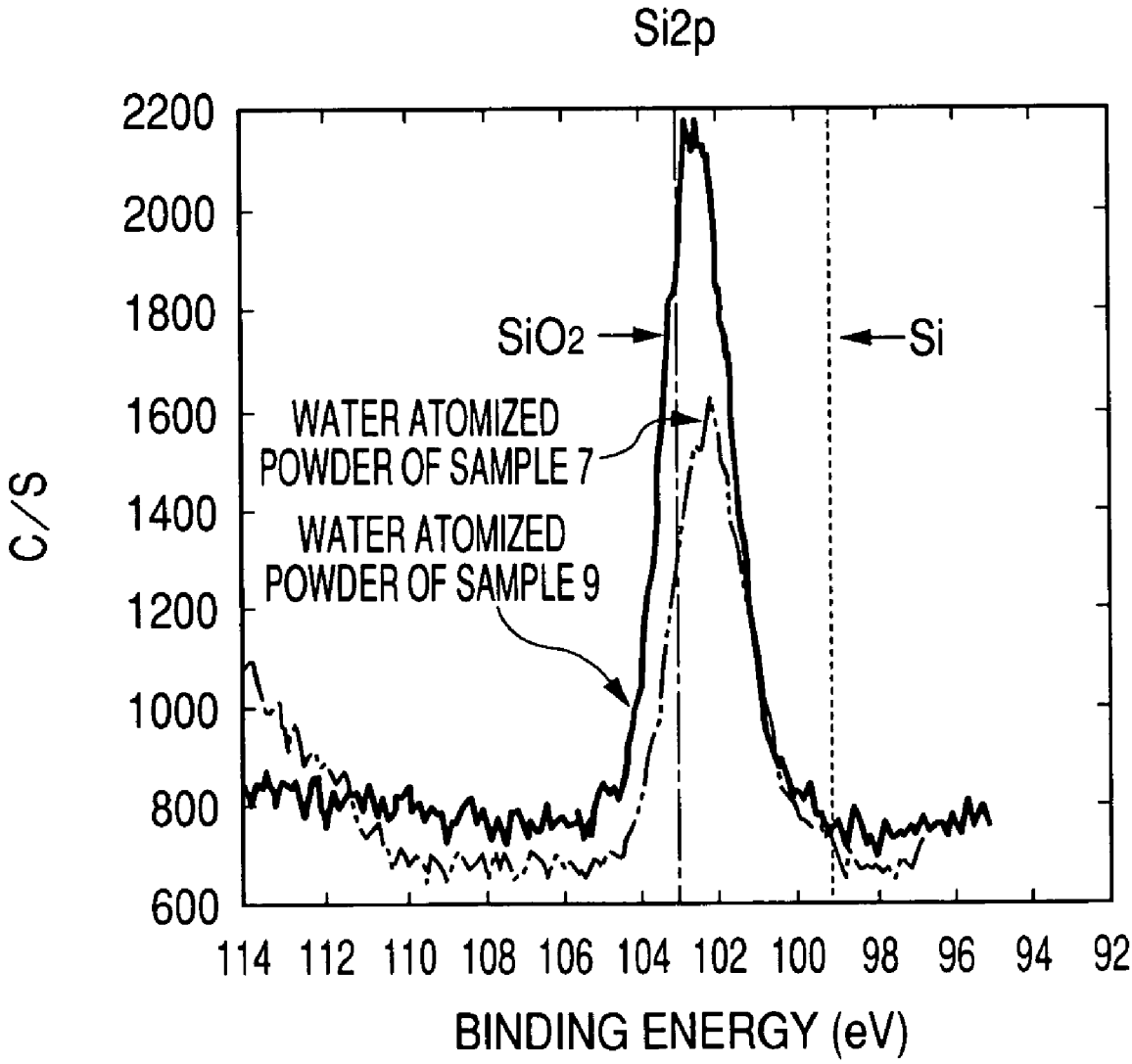
FIG. 8 is a view showing results from narrow band spectrum analysis observed for Si and $SiO_2$ using the same XPS, with respect to samples 7 and 9 shown in Table 1.

FIGS. 6, 7, and 8 show results from narrow band spectrum analysis observed for Si and $SiO_2$ using the same XPS, with respect to samples 7, 9, and 11 shown in Table 1. In any one of the samples 7, 9, and 11, it is clear that the peaks of Si and $SiO_2$ exist at regions in which the peaks have to exist.

Figure 9:
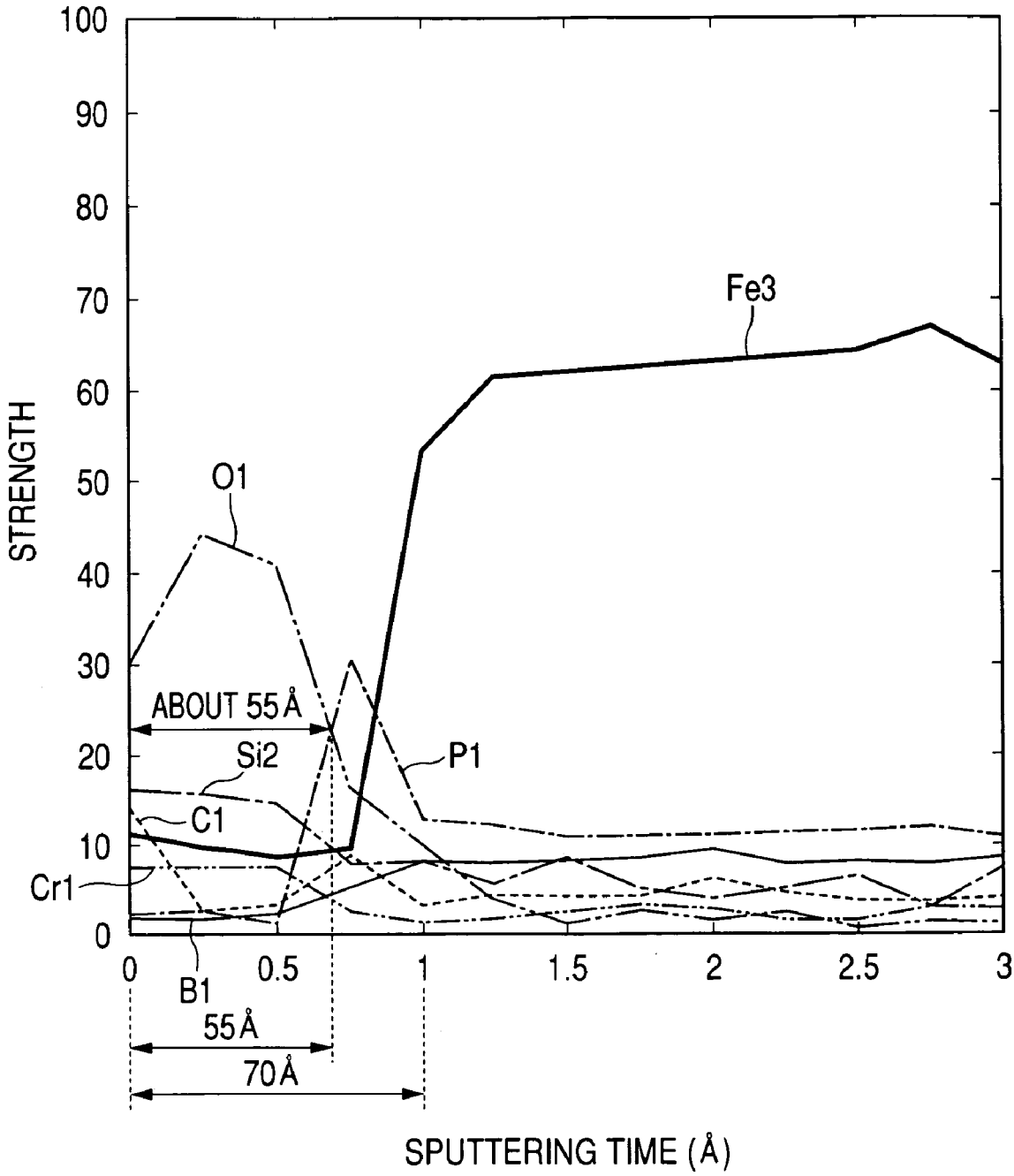
FIG. 9 shows results from AES analysis of a sample produced by a water atomization method, in the amorphous soft magnetic alloy powder of a sample 9 shown in Table 1.

FIG. 9 shows results from AES (Auger electron spectroscopy: depth direction analysis by an Ar sputter) of a sample produced by a water atomization method, in the amorphous soft magnetic alloy powder having a composition ratio of $Fe_{77.4}P_{7.3}C_{2.2}B_{7.7}Si_{5.4}$ (the sample 9 shown in Table 1). From the results, a layer of a high concentration of Si starts to be generated at a region around the depth 100 Å of the amorphous soft magnetic alloy powder sample. Specifically, it could be confirmed that the layer of a high concentration of Si was generated from the depth of about 60 Å up to the surface portion thereof. Further, at the surface region, the oxygen concentration is also increased.

From these measured results and results that the inventors of this invention have ever investigated, it is considered that the passive film of the amorphous soft magnetic alloy powder has Fe, Cr, B, and Si formed at the center thereof. Among them, it is considered that Si is deeply involved in improving the corrosion resistance of the water atomized powder and in preventing Fe from being excessively oxidized and corroded. Further, it can be assumed that the surface condition of the amorphous soft magnetic alloy powder affects characteristics of a core. The reason of this result is considered that, in case of producing amorphous soft magnetic alloy powders by a water atomization method, when liquid droplets of a molten alloy are convected during a solidification of the molten alloy, among elements contained, an element which is likely to be oxidized, brings into contact with water at the surface portion and thus is selectively oxidized to form a coating. On the contrary, in case that the amorphous soft magnetic alloy powders are produced using a gas atomization method, it seems that such a selective oxidation is hard to occur even though a rare gas such as Ar comes into contact with liquid droplets of the molten alloy. Therefore, it is considered that the difference in the surface condition of the amorphous soft magnetic alloy powder depends on the manufacturing method thereof.

Figure 10:
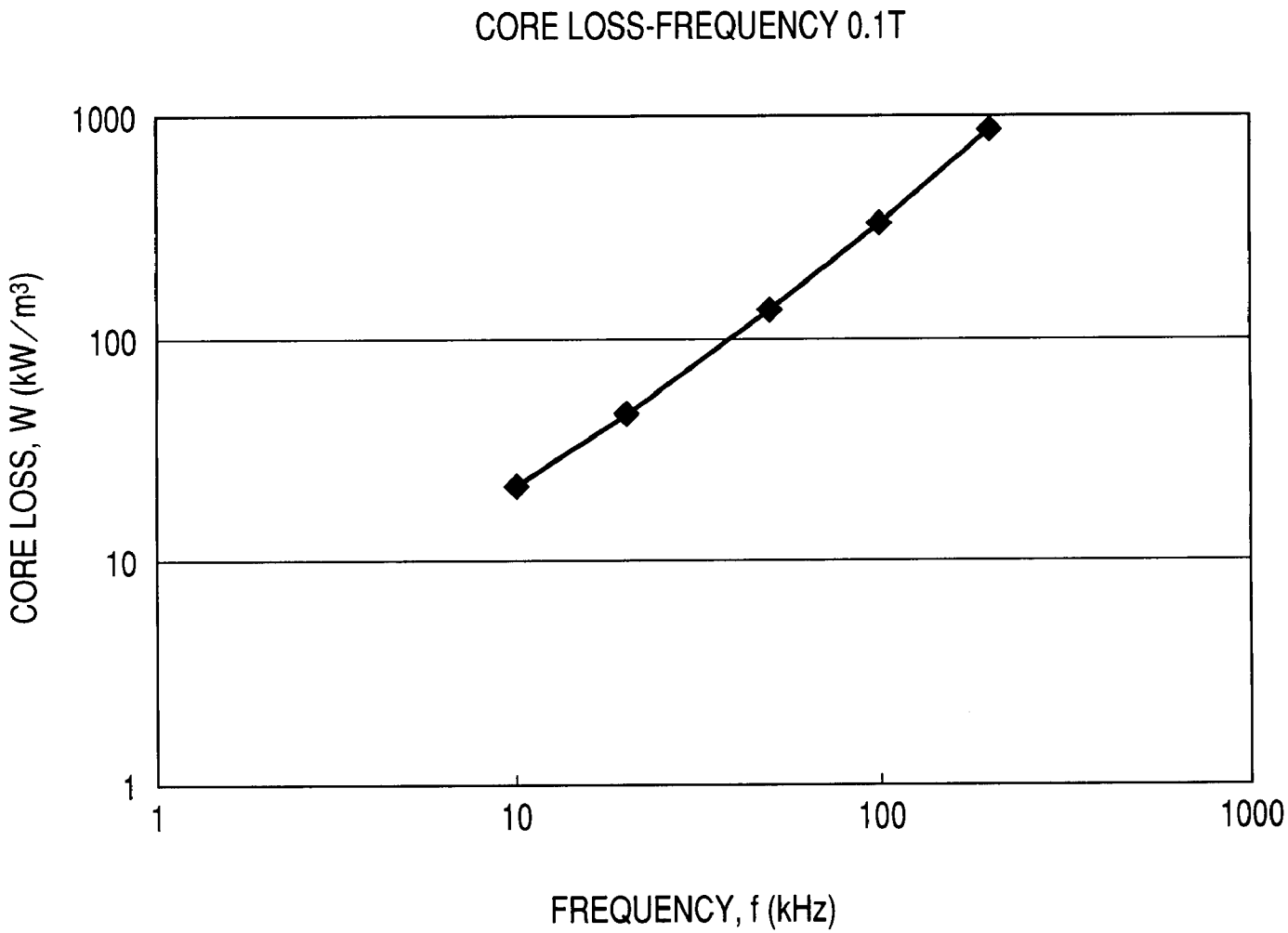
FIG. 10 is a graph showing measured results of the frequency characteristic of a core loss of the consolidated core of a sample 30 shown in Table 3.

FIG. 10 is a graph showing measured results of the frequency characteristic of a core loss of the consolidated core of a sample 30 shown in Table 3. It can be appreciated that this sample is capable of maintaining a low core loss even in a high frequency band.

Figure 11:
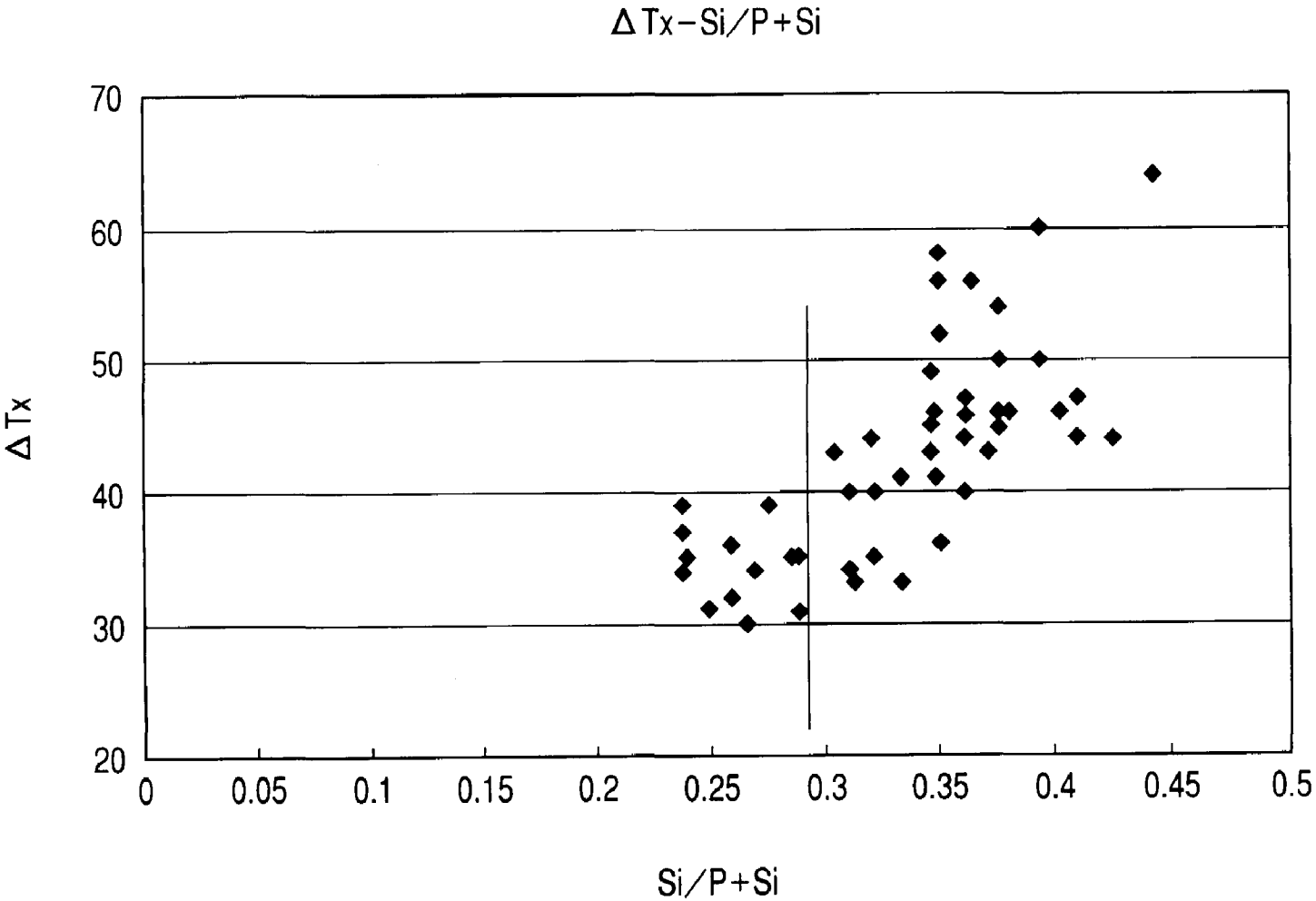
FIG. 11 is an explanatory diagram illustrating a relationship between values of ΔTx and values of {Si/(P+Si)} in the respective samples shown in Tables 1 to 6.

FIG. 11 is an explanatory diagram illustrating a relationship between values of ΔTx and values of {Si/(P+Si)} in the respective samples shown in Tables 1 to 6.

As it is apparent from FIG. 11, as the value of {Si/(P+Si)} increases, on the basis of the value near 0.28 before 0.3, the value of ΔTx increases. Further, the upper limit of the {Si/(P+Si)} is 0.45 at each Table.

From the comparison of samples 6 and 7, when the amount of Si is contained in an amount of 2 atomic % or more, the oxygen concentration and the specific surface area of powders are decreased. As a result, μ and the DC superimposing characteristic of a core are also improved. This is because a passive film is formed by placing Si at the center thereof and the oxidation and corrosion of Fe are decreased. On the contrary, when the amount of Si is less than 2 atomic %, the DC superimposing characteristic of the core deteriorates. Therefore, it can be understood that the amount of Si needs to be 2 atomic % or more.

Since the amorphous soft magnetic alloy powder having the above-described composition includes Fe which shows a magnetism and semimetal elements such as P, C, B, etc., which has an amorphous phase-forming ability, and Si as a main element, it is possible to constitute an amorphous soft alloy powder which shows an excellent soft magnetic characteristic and of which phase is composed of an amorphous phase as a main phase. Further, since the amorphous soft magnetic alloy powder is produced by a water atomization method under an atmospheric condition, compared to the gas atomization method using inert gas, the speed of quenching molten metal can be raised, the amorphization can be easily realized, and it is possible to constitute an amorphous soft magnetic alloy powder whose the structure is totally composed of an amorphous phase.

Further, the amorphization of the amorphous soft magnetic alloy powder according to the present invention can be realized even though a high-priced element such as Ga is not included, it is possible to produce the amorphous soft magnetic alloy powder with a low manufacturing cost, and to make the amorphous soft magnetic alloy powder of which magnetization is high and core loss is low.

Further, the amorphous soft magnetic alloy powder according to the present invention includes essentially Si. Si is concentrated at a portion adjacent to an outer surface of the powder particles as a high concentration of thin layer and improves a function thereof as a passive film. The passive film of Si is positioned at the surface portion of the powder particles, and thus it is possible to prevent an element such as Fe which is apt to be corroded from being unnecessarily corroded, when the powder particles are quenched from the molten alloy by a water atomization method, even though the atmosphere includes a high concentration of water and the temperature thereof is high. Further, the obtained amorphous soft magnetic alloy powder does not have a rust color such as reddish brown, and thus the magnetic characteristic thereof does not deteriorate.

Further, since a composition in which a part of the Fe is substituted with Co and Ni has a high corrosion resistance, it is possible to obtain a powder having a sufficiently low oxygen concentration even at the state in which a transition element such as Cr and a noble metal such as Pt for improving the corrosion resistance is not included, whereby a ratio of a magnetic element can be increased, the saturated magnetization can be enhanced, and the DC superimposing characteristic can be enhanced.

Further, it is possible to obtain an amorphous soft magnetic alloy powder which has nearly the shape of sphere or rugby ball, even though the water atomization method is employed. Preparation of the amorphous soft magnetic alloy powder which has a substantially spherical shape or a rugby ball shape, indicates the following: the molten alloy used for producing the amorphous soft magnetic alloy powder of the present invention includes an element for enhancing the amorphous phase-forming ability as described above because the molten alloy has a composition that equals or is nearly similar to that of the amorphous soft magnetic alloy powder of the present invention. Further, since the temperature interval ΔTx of a supercooled liquid is 20K or more, when the molten alloy is powdered and quenched under the atmosphere by spraying highly-pressed water to the molten alloy, even though the cooling rate thereof is set to be low to some extent, the resultant powder has a wide supercooled liquid region, the temperature thereof is lowered without crystallization, and it is possible to easily form an amorphous phase at a glass transition temperature Tg. Furthermore, the cooling rate may be set so that sufficient surface tension can act on the molten alloy. As a result, it is possible to obtain the amorphous soft magnetic alloy powder which has nearly the shape of a sphere or rugby ball.

The cooling rate of the molten alloy can be changed by controlling a spraying pressure and a spraying flow rate (an inner diameter of nozzle of the molten metal crucible) of water, and a flow rate of the molten alloy. Further, when the amorphous soft magnetic alloy powder of the invention is manufactured, a slit width of a spraying nozzle, an inclination angle of a water spraying nozzle, a water-spraying angle, temperature or viscosity of the molten alloy, an atomizing point (distance to a powdering point) and the like can be controlled in the manufacturing device, in addition to the cooling rate of the molten alloy.

Further, since the amorphous soft magnetic alloy powder of above-described composition can be produced by the water atomization method, a large-sized manufacturing apparatus can be implemented, and since the molten alloy can be powdered by the high-pressured water, a mass production property is enhanced. Further, since there is no need to use the high-priced inert gas, the manufacturing cost decreases.

The above-described amorphous soft magnetic alloy powder can reduce the loss while further improving the magnetic permeability and DC bias properties, as compared to the conventional material such as sendust or permalloy.

The invention claimed is:

1. An amorphous soft magnetic alloy powder, which is produced by a water atomization method in which liquid droplets of a molten alloy are jetted so as to bring into contact with water and are quenched, wherein the powder comprises Fe as a major component, contains at least P, C, B, and Si, comprises an amorphous phase having a temperature interval ΔTx of a supercooled liquid as represented by ΔTx=Tx−Tg (wherein Tx is a crystallization initiation temperature and Tg is a glass transition temperature, respectively) of 20K or more, has a hardness Hv of 1000 or less, is provided with a layer with a high concentration of Si at a surface portion thereof, and is represented by the following composition formula:

$$Fe_{100-a-b-x-y-z-w-t}Co_aNi_bM_xP_yC_zB_wSi_t$$

wherein M is one or two or more elements selected from Cr, Mo, W, V, Nb, Ta, Ti, Zr, Hf, Pt, Pd, and Au, with a, b, x, y, z, w and t representing composition ratios in a range of $0 \leqq x \leqq 3$, $2 \leqq y \leqq 15$, $0 \leqq z \leqq 8$, $1 \leqq w \leqq 12$, $0.5 \leqq t \leqq 8$, $0 \leqq a \leqq 20$, $0 \leqq b \leqq 5$ and $70 \leqq (100-a-b-x-y-z-w-t) \leqq 80$ in atomic %, respectively.

2. The amorphous soft magnetic alloy powder according to claim 1, wherein contents of Si and P satisfy a relation of $0.28<\{Si/(P+Si)\}<0.45$.

3. The amorphous soft magnetic alloy powder according to claim 1, wherein the layer with a high concentration of Si is formed within a depth of 100 Å from the surface of the powder.

4. The amorphous soft magnetic alloy powder according to claim 1, wherein the powder comprises an alloy having magnetic characteristics of a saturated magnetization σs of not less than $180\times10^{-6}$ Wbm/kg and a coercive force of not more than 10 A/m.

5. A flat amorphous soft magnetic alloy powder, which is produced by flattening the amorphous soft magnetic alloy powder according to claim 1.

6. A dust core, which is obtained by mixing one or more amorphous soft magnetic alloy powders according to claim 1, an insulating material, and a lubricant granulating the resultant mixture into a granulated powder and solidifying and molding the granulated powder, wherein the insulating material serves as a binder.

7. A dust core, which is obtained by mixing one or more amorphous soft magnetic alloy powders according to claim 1, an insulating material, and a lubricant and granulating the resultant mixture into a granulated powder and solidifying and molding the granulated powder, wherein the insulating material serves as a binder, thereby consolidating the amorphous soft magnetic alloy powder which comprises an alloy having magnetic characteristics of a saturated magnetization σs of not less than $180\times10^{-6}$ Wbm/kg and a coercive force of not more than 10 A/m and has a D50 of 5 to 30 μm, a tap density of 3.7 $Mg/m^3$ or more, a specific surface area of 0.35 $m^2/g$ or less, and an oxygen concentration of 3000 ppm or less, wherein the dust core has W of 400 $kW/m^3$ or less at 100 kHz, 0.1 T, and a constant magnetic permeability (μ') of 60 to 100 at 1 MHz or less, and exhibits μ (DC=5500 A/m) of 35 to 40.

8. A wave absorber, which is obtained by mixing a flat amorphous soft magnetic alloy powder produced by flattening the amorphous soft magnetic alloy powder according to claim 1 with an insulating material.

* * * * *